US005078836A

United States Patent [19]

Hogan

[11] Patent Number: 5,078,836

[45] Date of Patent: Jan. 7, 1992

[54] METHOD AND APPARATUS FOR RETORTING MATERIAL

[76] Inventor: Jim S. Hogan, 1742 Country Club Dr., Sugar Land, Tex. 77478

[21] Appl. No.: 384,336

[22] Filed: Jul. 21, 1989

[51] Int. Cl.[5] ..... C10B 1/10; C10B 49/18

[52] U.S. Cl. ..... 201/7; 201/12; 201/32; 201/33; 202/100; 202/108; 202/117; 202/136; 202/216; 202/265; 432/106; 432/114; 432/118

[58] Field of Search ..... 201/3, 6, 7, 12, 14, 201/32, 33; 202/114, 115, 116, 117, 118, 131, 136, 137, 218, 262, 265, 100, 216, 108; 110/246; 432/103, 106, 114, 117, 118; 34/128; 422/209, 224, 233

[56] References Cited

U.S. PATENT DOCUMENTS

| | | | |
|---|---|---|---|
| 1,495,573 | 5/1924 | Cantieny | 202/118 |
| 1,573,824 | 2/1926 | Griffiths | 202/136 |
| 1,677,758 | 4/1972 | Frank | 202/8 |
| 1,881,826 | 10/1932 | McQuade | 202/118 |
| 1,927,244 | 9/1933 | Pier et al. | 233/15 |
| 3,020,212 | 2/1962 | Lantz | 202/118 |
| 3,142,546 | 7/1964 | Coats | 432/117 |
| 3,481,720 | 12/1969 | Bennett | 48/89 |
| 3,607,121 | 9/1971 | Watson | 422/233 |
| 3,691,019 | 9/1972 | Brimhall | 202/118 |
| 3,787,292 | 8/1971 | Keappler | 202/118 |
| 4,247,367 | 1/1981 | Reilly | 202/105 |
| 4,259,060 | 3/1981 | Korzeb | 432/3 |
| 4,261,795 | 4/1981 | Reilly | 202/118 |
| 4,280,879 | 7/1981 | Taciuk | 202/136 |
| 4,285,773 | 8/1981 | Taciuk | 202/100 |
| 4,439,209 | 3/1984 | Wilwerding et al. | 48/76 |
| 4,477,984 | 10/1984 | Wenger | 34/128 |
| 4,730,564 | 3/1988 | Abboud | 110/247 |

*Primary Examiner*—Joye L. Woodard
*Attorney, Agent, or Firm*—A. Triantaphyllis

[57] ABSTRACT

An apparatus and a method are disclosed for the thermal treatment of feed material containing solids and liquids such as solid waste or the like. The apparatus includes one or more coaxial rotatable drums and one or more free rotating spirals advancing the material in the drums. The material flowing through the drums is heated to form solids and vapors. In one or more embodiments of the apparatus, the hot solids and vapors exchange heat with the cold feed material. An extruder for preparing the solids being produced from the apparatus for disposal and a means for rotating the drums are also disclosed.

51 Claims, 13 Drawing Sheets

METHOD AND APPARATUS FOR RETORTING MATERIAL

FIELD OF THE INVENTION

This invention relates to the field of rotating kilns or retorts used for the treatment or processing of material such as solid waste or other solid-containing material requiring thermal treatment, and, more particularly to a retort utilizing novel and unique means for advancing the material in the retort to eliminate the disadvantages of the prior art. Still more particularly, the present invention relates to a method and a retort that utilizes one or more free rotating spirals in the drums of the retort to advance the material in the retort.

BACKGROUND OF THE INVENTION

Rotating kilns or retorts are well known in the art. Furthermore, the thermal treatment of waste or other materials requiring such treatment is well-known. Because of their solid or near solid nature, the advancement of materials being processed in the retorts is facilitated by mechanical devices such as screw conveyors, fixed spirals, spirally arranged fixed baffles or paddles, or the like.

In general, screw conveyors are disposed to the interior of a fixed drum. The screw conveyor which is driven by external driving means advances the material in the drum from an inlet to an outlet point. Heat is supplied directly or indirectly to the exterior of the drum. Because, oftentimes, the materials being processed by retorts include hazardous substances, it is necessary that seals be utilized at the inlet and the outlet of the retort to prevent the escape of those substances to the atmosphere. Because the thermal treatment of such material is carried out at temperatures exceeding 1500° F., the seals sealing the outlet of the retorts from the atmosphere are exposed to those high temperatures and are subject to failure.

Fixed spirals, spirally arranged baffles or paddles, or the like are usually integrally attached to the interior of a rotating drum. As the drum rotates, the fixed spiral, baffles or paddles, or the like advance the material from the inlet to the outlet of the drum Retorts utilizing those mechanical means also require the use of seals in the outlet thereof which are also exposed to thermal stress that causes them to fail. Another disadvantage of those retorts is that the material being processed therein usually is coked due to the exposure to the high temperature and sticks to the walls thereof or the fixed driving element. As a result, the operation becomes inefficient because the heat transfer is reduced and because it requires frequent shut-downs and clean-ups.

Retorts have also been utilized by the prior art wherein a rotating drum is sloped to utilize gravity for the advancement of the material processed therein from the inlet to the outlet. Those retorts also utilize outlet seals which are subject to metal fatigue caused by the high temperature. Furthermore, these retorts experience the sticking of the material to the interior walls of the drum and are subject to the inefficiencies resulting therefrom.

Oftentimes, material being processed by retorts require thermal treatment for a substantial amount of time because the heat transfer coefficient is low. As a result, the drums of the retorts are usually long thereby occupying a large portion of a treatment facility.

The present invention discloses a retort that utilizes one or more freely rotating spirals in one or more rotating drums. The use of the free rotating spiral or spirals eliminates the need of external driving means thereby reducing the energy consumption; eliminates the use of an outlet seal which is exposed to the high temperature of the operation; reduces the problem of sticking material encountered by the retorts of the prior art; reduces the friction and wear on the spiral that advances the material in the retort; provides for the countercurrent flow of cold and hot material in the retort to improve the thermal efficiency of the retort and to obtain a cooled outlet; and reduces the overall length of the retort. Furthermore, the use of one or more free rotating spirals by the apparatus of the present invention facilitates the use of recirculating carriers in the retort to accomplish the crushing of the coked or otherwise solidified material in the retort and to improve the efficiency of the operation.

Other objects and advantages of the invention will become apparent from the following description.

SUMMARY OF THE INVENTION

Accordingly, retorts for the treatment of material are disclosed utilizing one or more drums and one or more free rotating helical or spiral elements that advance the material in the drum or drums from the inlet to the outlet of the retorts. In one embodiment, the retort includes one rotatable drum having disposed therein a freely rotatable helical element or spiral that rotates freely as the drum rotates to advance the material from the inlet to the outlet of the drum.

In another embodiment, the retort includes a rotatable exterior cylindrical drum and an interior cylindrical drum being coaxially disposed in the exterior drum to form an annular passage between the two drums. The back end of the exterior drum is closed by a circular plate. The back end of the interior drums is integrally attached to the circular plate so that the interior drum rotates together with rotatable exterior drum. Immediately adjacent to the circular plate, the interior drum has an opening. A scoop extends from the interior surface of the exterior drum to the exterior surface of the interior drum to scoop material from the annular passage and to convey it to the interior of the interior drum through the opening, as the two drums rotate.

On the front end of the retort, the interior drum is coaxially supported in the exterior drum by a fixed spiral. The interior circumstance of the fixed spiral is integrally attached to the exterior surface of the interior drum. The fixed spiral has an increased diameter portion whose exterior circumference is integrally attached to the interior circumference of the exterior drum. The fixed spiral is comprised of spirally arranged baffles that advance the material from the front end of the retort towards the annular passage, as the drums rotates. A freely rotatable spiral is disposed in the annular passage and rotates freely therein, as the two drums rotate. The spiral is spirally configured to advance the material in the annular passage from the fixed spiral to the scoop during such rotation. Another freely rotatable spiral is disposed in the interior drum and rotates freely therein as the two drums rotate. The spiral is spirally configured to advance material in the interior drum from the back end of the drum to the front end thereof.

The front end of the retort is closed by a connector head received between the reduced diameter portion of the fixed spiral and the exterior drum. Seals seal between the connector head and the exterior drum and between the connector head and the interior drum. The connector head includes an inlet pipe for flowing material to the fixed spiral, a lower outlet pipe for removing solids from the retort, and an upper outlet pipe for removing vapors from the retort. The connector head remains stationary, as the exterior and interior drums and the fixed spiral rotate.

The exterior drum is supported by support rings which are, in turn, supported by roller wheels for rotation. The roller wheels rotate the exterior drum.

An enclosure is received over the exterior drum and forms a heating chamber therebetween. Seals seal between the enclosure and the support rings. The enclosure remains stationary, as the drums rotate. A recirculation loop provides hot gases from a burner to the to heating chamber to heat the exterior drum. A portion of the cooled gases is returned to the burner to cool the burner tube and is then, reheated and recirculated to the heating chamber. Exhaust gases exit the chamber through an exhaust.

In operation, cold material feed, such as solid waste or other similar material comprised of solids and liquids and requiring thermal treatment flows to the retort. As the exterior and interior drums and the fixed spiral rotate as one piece, and as the free rotating spirals rotate freely, the material flows through the annular passage where the material is heated to a high temperature to form solids and vapors. The scoop conveys the solids to the interior of the interior drum through the opening. The vapors also flow therethrough. As the hot solids and vapors flow in the interior drum towards the front end of the retort, countercurrently to the colder material flowing in the annular passage, they release heat to the colder material. The cooled solids and vapors flows to the connection head and exit from the retort through the lower and upper outlet pipes, respectively.

Oftentimes, as the vapors get colder towards the front end of the retort, they tend to condense into the solids. In order to avoid such condensation, in an alternative embodiment of the invention, a vapor recovery tube is inserted coaxially in the interior of the interior drum to replace the upper outlet pipe of the previous retort. The vapor recovery tube is integrally connected to the plate that closes the back ends of the exterior and interior drums, and it extends through the connector head to the exterior thereof. The vapor recovery tube has an opening adjacent to the plate. The hot vapors flow to the tube through that opening whereby they are separated from the solids before they have the opportunity to condense. The vapors from the tube flow to a collection head. On the front end of the retort, a fixed spiral is placed between the tube and the interior drum to support the spiral therein. The fixed spiral advances solid material to the connector head.

A steam injection line is placed in the lower outlet pipe. The steam injection line applies steam to the outflowing solids, vaporizes any residual vapors therein and returns them to the retort.

In another embodiment, the previous embodiment is modified to provide for the internal recirculation of carriers such as spherical objects in the retort to crush and pulverize the coked solids. A short carrier separation drum is coaxially placed between the interior drum and the vapor recovery tube. The carrier separation drum has means for separating the carriers from the crushed solids, recirculating the carriers internally, and advancing the crushed solids in the annular spaces between the vapor recovery tube, the carrier separation drum and the interior drum.

In order to decrease the overall length and to increase the thermal efficiency of the previous retort further, the retort is modified to provide for the countercurrent flow of the material through two additional chambers prior to being conveyed by the scoop to the interior drum. Two additional drums of different diameters are placed coaxially over the drum which has been previously referred to as the external drums to form those chambers. Freely rotatable spirals are placed in the chambers to advance the material therethrough.

An extruder is provided to compress the solid material flowing from the retorts. The extruder includes a sloped extruder tube and a feed line for flowing the material from the retort outlet to the extruder tube. A reciprocating piston compresses the solids therein to remove entrained vapors and to prepare the solids for disposal.

An apparatus is also provided to rotate the exterior drum of the aforementioned retorts. The enclosure that was described above as enclosing the exterior drum to form the heating chamber is modified to eliminate the seal between the enclosure and the exterior drum, on the hot end. The modified enclosure extends beyond the back end of the exterior drum. The extended end is closed with a plate. Two closed loop chains are received over the exterior drum and over two corresponding cogwheels which are outside the enclosure. The chains pass through openings in the walls of the enclosure and through tubes extending from such openings. The cogwheels rotate the chains which, in turn, rotate the drum. Cold compressed air is provided to cool the chains and to provide a blanket that prevents the flow of hot gases from the heating chamber to the atmosphere through the openings.

BRIEF DESCRIPTION OF THE DRAWINGS

For a detailed description of the preferred embodiments of the present invention, reference will now be made to the accompanying drawings wherein.

DESCRIPTION OF THE PREFERRED EMBODIMENTS

(a) Free Rotating Screw or Spiral

Figure 1:
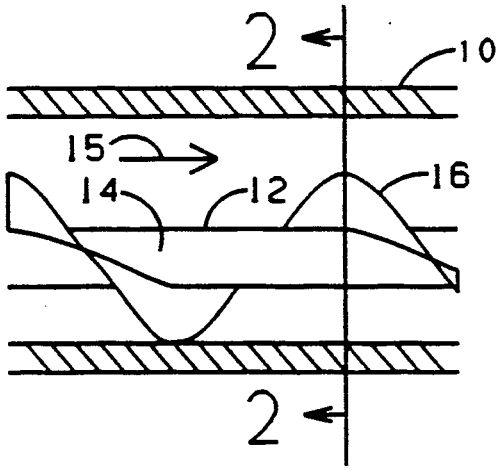
FIG. 1 is a fragmentary elevational view, partially in cross-section, illustrating a section of one form of the apparatus of the present invention.

Referring now to FIG. 1, there is shown a horizontal rotating drum 10 having disposed therein a freely rotating screw conveyor 12. Screw conveyor 12 is comprised of a shaft 14 and a helical blade 16 rigidly attached over shaft 14. Screw conveyor 12 is referred to herein as a freely or free rotating screw conveyor 12 because it is not connected or attached to an external driving apparatus as is taught by the prior art; instead, screw conveyor 12 is allowed to rotate freely inside drum 10 as drum 10 rotates.

In operation, as drum 10 rotates clockwise, screw conveyor 12 rotates clockwise also and pushes any material being processed in drum 10 forward from left to right in the direction of arrow 15. Although screw conveyor 12 is in contact with the interior of drum 10, screw conveyor 12 is not integrally attached to drum 10 and is allowed to freely rotate in a clockwise direction as the drum 10 rotates clockwise because of the friction between the inside wall of drum 10 and the exterior circumference of blade 16. Screw conveyor 12 rotates at a greater rounds per unit time than drum 10 because the exterior circumference of blade 16 is smaller than the circumference of the inside wall of drum 10. It is clearly understood by one skilled in the art that the speed of the two circumferences, that is, the exterior circumference of blade 16 and the circumference of inside wall of drum 10 is the same in terms of length unit per time unit.

One advantage of the apparatus shown in FIG. 1 is that it does not require the use of an external driver to drive screw conveyor 12. Another advantage is that screw conveyor 12 tends to crush and pulverize the materials being processed in drum 10 as the edge of blade 16 rubs and grinds along the inside wall of drum 10. Still another advantage of this apparatus is that the movement of blade 16 prevents the sticking of material being processed in the drum to the screw conveyor 12 as the feed dries out and cokes, a problem that is encountered in prior art apparatus utilizing a spiral being rigidly attached to the interior wall of drum 10.

Figure 2:
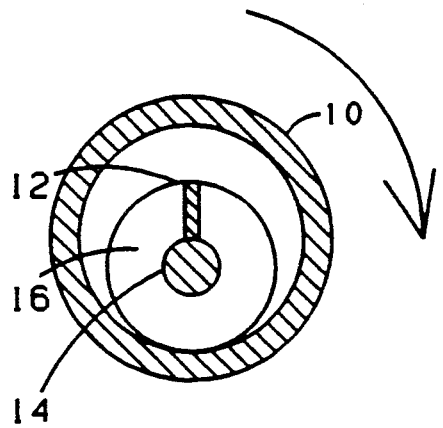
FIG. 2 is a cross-section of the apparatus of FIG. 1 taken along the plane shown by line 2—2 in FIG. 1.

Referring now to FIG. 2, there is shown a cross-section along line 2—2 of FIG. 1 depicting drum 10 rotating clockwise. Screw conveyor 12 having rod 14 and blade 16 rotates clockwise also.

Figure 3:
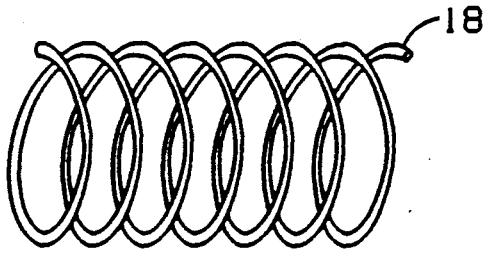
FIG. 3 is an elevational view of a spiral used with one form of the apparatus of the present invention.

In an alternative embodiment of the apparatus shown in FIG. 1, screw conveyor 12 can be replaced with spiral 18 shown in FIG. 3. Spiral 18 rotates freely in drum 10, like screw conveyor 12, and pushes the material being processed in drum 10 from left to right. Spiral 18 is herein referred to as a free or a freely rotating or rotatable spiral. One advantage of spiral 18 is that is has the ability to bend, twist, flex and move more than screw conveyor 12 thereby preventing the sticking of materials being processed to the wall of drum 10 or to spiral 18, as the material dries out and cokes. Another advantage is that additional drums or tubes can be placed inside spiral 18, as shown by the description below.

Figure 4:
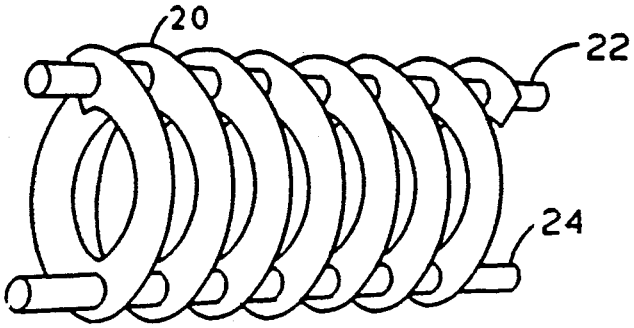
FIG. 4 is an elevational view of another spiral used with another form of the apparatus of the present invention.

Still another alternative embodiment of FIG. 1 can utilize a spiral 20 as shown in FIG. 4, instead of screw conveyor 12 or spiral 18. Spiral 20 is stabilized by rods 22, 24 connecting the rims of spiral 20 on directly opposite or suitably spaced sides to prevent the excessive expansion or retraction of the spaces between the spiral.

(b) Retort With Free Rotating Spirals and Countercurrent Chambers

Figure 5:
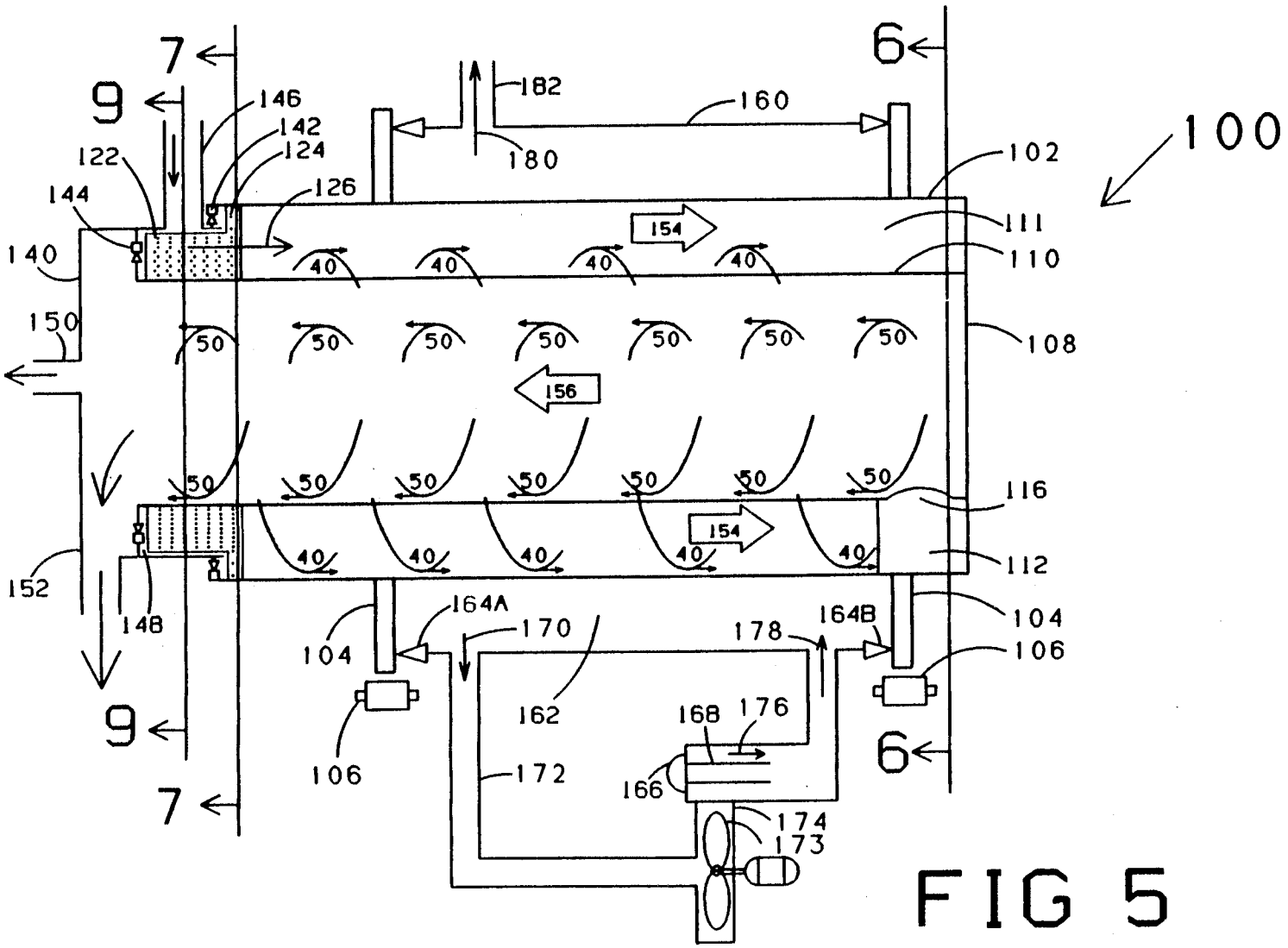
FIG. 5 is a schematic vertical sectional view of a retort according to the present invention.

FIG. 5 shows a schematic of a retort 100 utilizing free rotating spirals 40 and 50 similar to free rotating spiral 18 previously described. Retort 100 includes a rotatable exterior drum 102 supported by support rings 104 for rotation. Roller wheels 106 with bearings (not shown) support rings 104. Roller wheels 106 are rotated by driving means (not shown) to rotate drum 102. Other conventional driving means being attached to drum 102 may be used to rotate drum 102. Furthermore, driving means which are described below can be used, as described herein.

Drum 102 is closed on one end by plate 108. An interior drum 110 is coaxially disposed in drum 102 and forms a chamber 111 therebetween. Drum 110 is integrally attached to plate 108 whereby drum 110 rotates together with drum 102.

Immediately adjacent to plate 108, a scoop 112 extends from the interior surface of drum 102 to the exterior surface of drum 110. Scoop 112 is a curved baffle which is arranged accordingly so as to lift material from the back or right end of drum 102 and to convey such material to the back end of drum 110 through opening 116 of drum 110, as drums 102 and 110 rotate clockwise.

Figure 6:
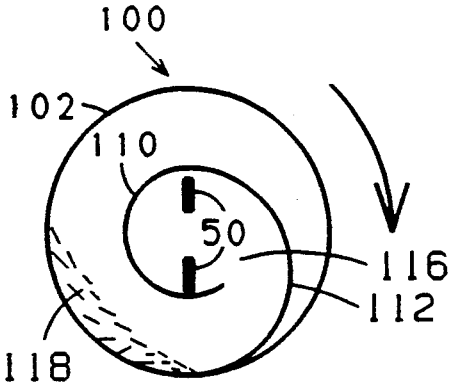
FIG. 6 is a reduced and not to scale cross-sectional schematic of the apparatus of FIG. 5 taken along the plane shown by line 6—6 in FIG. 5, showing the apparatus in one position.

Referring now to FIG. 6, there is shown a cross section of retort 100 along line 6—6 of FIG. 5. There is shown scoop 112 extending from the interior surface of drum 102 to the exterior surface of drum 110. Opening 116 of drum 110 is adjacent to scoop 112 for receiving material 118 being lifted by scoop 112 as drums 102 and 110 rotate clockwise. FIG. 6 also shows spiral 50 being disposed in drum 110, as hereinafter described.

Figure 6A:
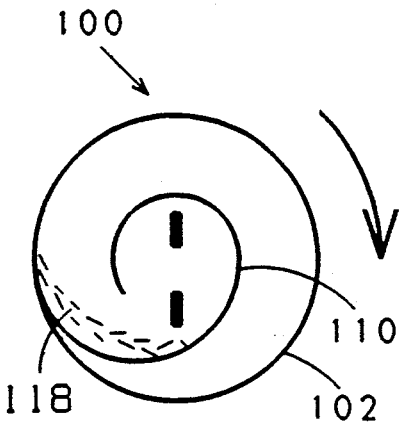
FIG. 6A is a reduced and not to scale cross-sectional schematic of the apparatus of FIG. 5 taken along the plane shown by line 6—6 in FIG. 5 showing the apparatus following a ninety-degree rotation from the position shown in FIG. 6.
Figure 6B:
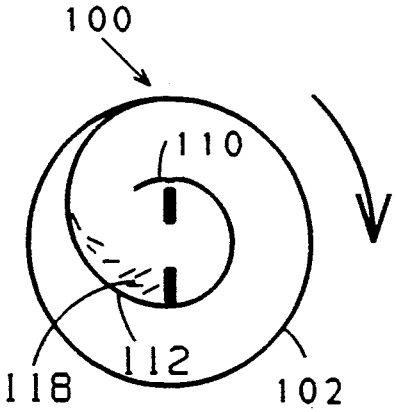
FIG. 6B is a reduced and not to scale cross-sectional schematic of the apparatus of FIG. 5 taken along the plane shown by line 6—6 in FIG. 5 showing the apparatus following a one hundred and eighty degree rotation from the position shown in FIG. 6.

FIGS. 6A and 6B depict a schematic of the cross section of retort 100 shown in FIG. 6 after one-quarter and one-half rotations, respectively, showing the process of material 118 being conveyed from drum 102 into drum 110 by scoop 112 through opening 116, as drums 102 and 110 rotate clockwise.

Referring back now to FIG. 5, on the front end, drum 110 is supported coaxially within drum 102 by a fixed spiral 122. The interior circumference of spiral 122 is integrally attached to the exterior circumference of drum 110 by welding or similar means. Spiral 122 includes an increased diameter portion 124 whose exterior circumference is integrally attached to the interior surface of drum 102. The front end of drum 110 and a portion of spiral 122 extend beyond the front end of drum 102.

Spiral 122 is comprised of spirally arranged baffles which are configured to advance material being processed in retort 100 in the direction shown by arrow 126 as drums 102 and 110 rotate clockwise. Spiral 122 can also be comprised of a series of paddles or similar means, well known in the art, spirally arranged to effect the same advancement. Spiral 122 is herein referred to as a fixed spiral because it is integrally attached to drum 102 and 110 whereby it rotates together with those drums in a fixed relative position.

Figure 7:
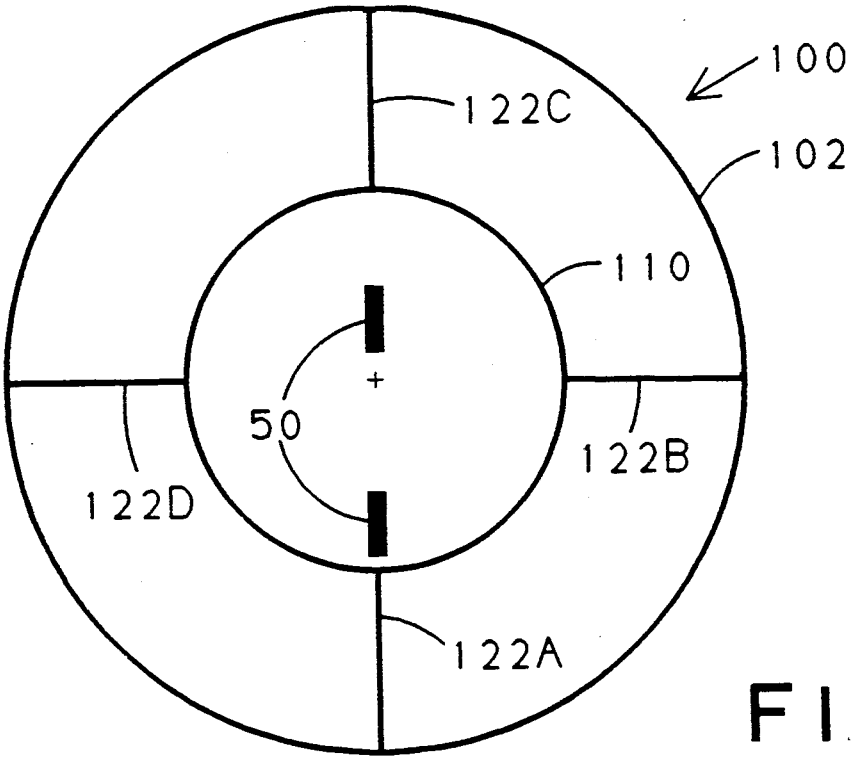
FIG. 7 is an enlarged and not to scale cross-sectional schematic view of the apparatus of FIG. 5 taken along the plane shown by line 7—7 in FIG. 5.

FIG. 7 is a cross section of retort 100 taken along line 7—7 of FIG. 5. There is shown drum 110 being coaxially disposed in drum 102. Spirally arranged baffles 122A, 122B, 122C, and 122D which form fixed spiral 122 are integrally attached to drums 102 and 110. Free rotating spiral 50 is disposed in drum 110.

Figure 8:
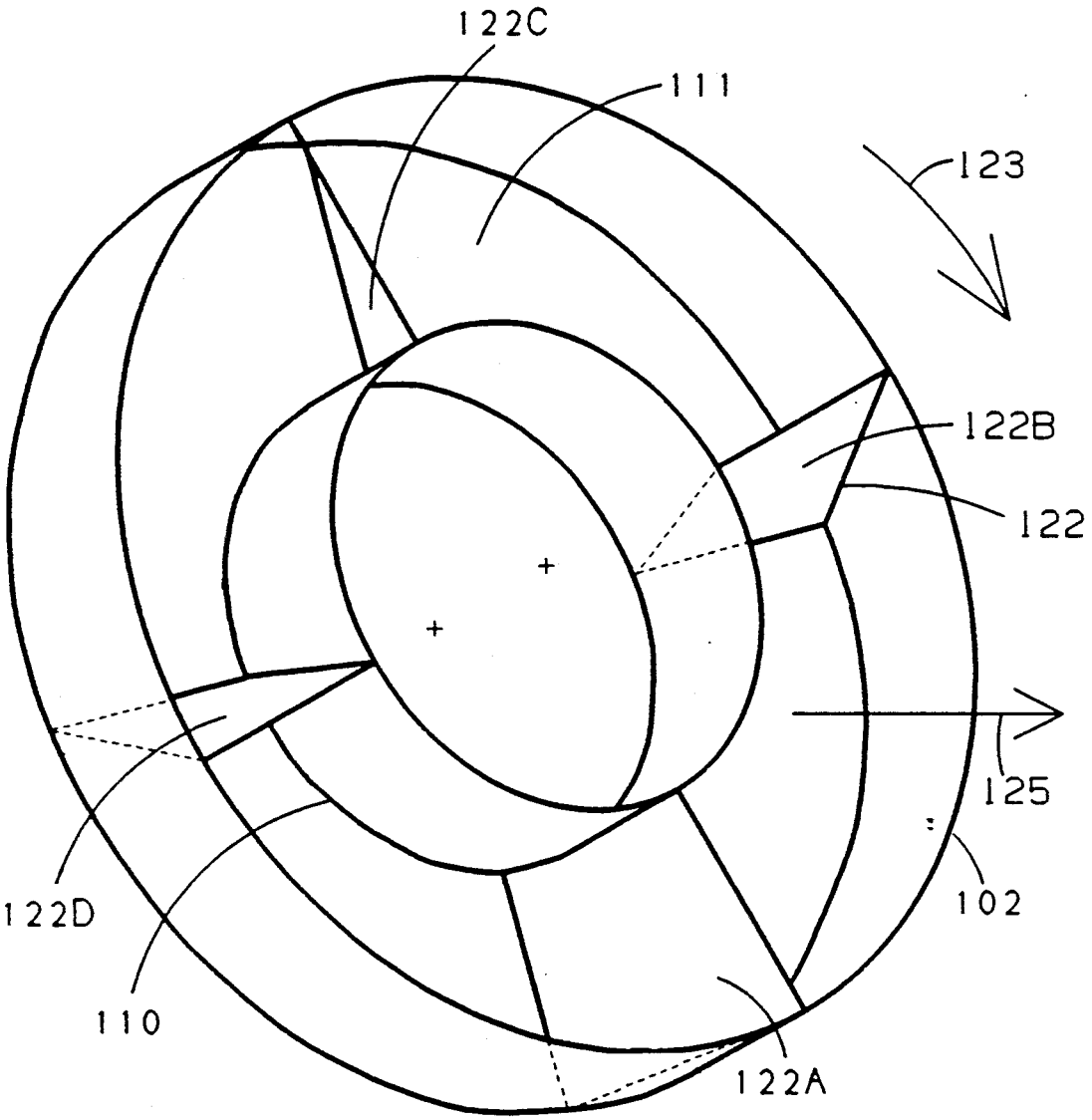
FIG. 8 is an enlarged and not to scale perspective view of a section of the apparatus of FIG. 5.

FIG. 8 is an enlarged isometric view of a section of retort 100 of FIG. 5 showing a portion of the increased diameter portion of fixed spiral 122. Spiral 122 is comprised of spirally arranged baffles 122A, 122B, 122C, and 122D. The exterior circumference of spiral 122 is integrally attached by welding or similar means to the interior surface of exterior drum 102. The interior circumference of spiral 122 is similarly attached to the exterior surface of interior drum 110. As drums 102 and 110 and spiral 122 rotate clockwise as one piece in the direction shown by arrow 123, material flows through chamber 111 in the direction shown by arrow 125. It should be noted that, although free rotating spiral 50 is disposed in the interior of interior drum 110, spiral 50 is not shown in FIG. 8.

Referring now again to FIG. 5, retort 100 also includes a tubular connector head 140 for enclosing the front end thereof. Head 140 has an open end which is inserted between the exterior circumference of spiral 122 and the interior surface of drum 102. Seal 142 provides a seal between the interior surface of drum 102 and the exterior surface of connector head 140. Seal 144 provides a seal between the interior surface of connector head 140 and the exterior surface of drum 110.

An inlet pipe 146 is connected to connector head 140 to provide an inlet to a chamber 148 which is formed between drum 110, head 140, and seals 142 and 144. An upper outlet pipe 150 provides an outlet from connector head 140 for vapors exiting drum 110, as hereinafter described. A lower pipe 152 provides an outlet conduit for solids exiting drum 110, as hereinafter described.

Figure 9:
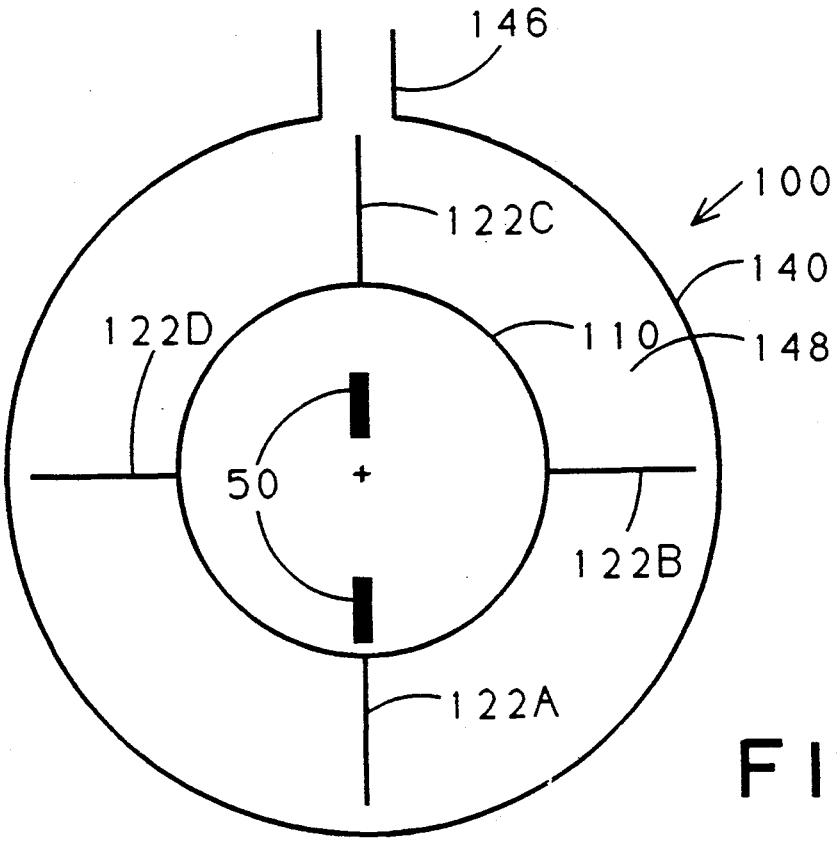
FIG. 9 is an enlarged and not to scale cross-sectional schematic of the apparatus of FIG. 5 taken along the plane shown by line 9—9 in FIG. 5.

FIG. 9 is a cross section of retort 100 taken along line 9—9 of FIG. 5. There is shown connector head 140 enclosing drum 110 and forming chamber 148 therebetween. Material to be processed by retort 100 flows into chamber 148 via inlet pipe 146. Baffles 122A, 122B, 122C, and 122D are integrally attached to drum 110, but not to head 140. Spiral 50 is disposed in drum 110, as hereinafter described.

Referring now back to FIG. 5, free rotating spiral 40, which is similar to spiral 18 previously described, is received over drum 110 and is allowed to freely rotate within drum 102 as drums 102 and 110 rotate, as hereinafter described. Spiral 40 is configured to advance material being processed by retort 100 in drum 102 towards the direction shown by arrow 154 as drums 110 and 102 rotate clockwise. Spiral 40 is appropriately sized to freely rotate within drum 102 by rolling on the interior cylindrical surface of drum 102.

Free rotating spiral 50 is positioned in the interior of drum 110 and is allowed to rotate freely within drum 110, as drum 110 rotates. Spiral 50 is configured to push material being processed by retort 100 in the direction shown by arrow 156, as drum 110 rotates clockwise.

An enclosure 160 encloses drum 102 and forms a heating chamber 162 therebetween. Chamber 162 is provided with seals 164A and 164B against support rings 104 to seal the atmosphere from chamber 162. Enclosure 160 is not rotatable and remains stationary as drum 102 rotates.

Burner 166 with a fire tube 168 has a flame chamber for containing a flame. Combustion air and fuel (not shown) are supplied to burner 166. The heat is transmitted to drum 100 indirectly, without applying the flame of burner 166 to drum 102, by circulating hot gases around drum 102 in chamber 162, recirculating and reheating those gases in burner 166 and recirculating those reheated gas to chamber 162 for further heating of drum 102 More particularly, after they supply heat to drum 102 by flowing around the exterior surface thereof in chamber 162, cooled gases 170 are drawn through recirculation blower suction pipe 172 from chamber 162 by a recirculation fan 173 to recirculation fan discharge pipe 174 where recirculation fan discharge gases 176 are forced to encircle fire tube 168. Gases 176 cool fire tube 168 and continue on to blend with the products of combustion from burner 166 to form a hot gas 178 which is colder than the products of combustion and hotter than recirculation fan discharge gases 176. Hot gas 178 circulates over the exterior surface of drum 102 in chamber 162 to provide heat to the interior of drum 102. As gas 178 progresses over the exterior surface of drum 102, it is gradually cooled. The cooled gas is drawn by fan 173 through pipe 172 as cooled gas 170 and the recirculation is repeated. The amount of recirculated cooled gas 170 is controlled by damper means (not shown) in pipe 172.

The products of combustion from burner 166 that are not recirculated as cooled gases 170 flow from the cold end of chamber 162 to the atmosphere as exhaust gases 180 through exhaust stack 182. This method and apparatus of providing heat to drum 102 is described in detail in U.S. Pat. No. 4,872,954, the entire content of which is incorporated herein and made a part hereof by reference.

The above description shows that, in operation, drum 110 is integrally attached to drum 102 and fixed spiral 122 is integrally attached to drum 102 and 110. Those components rotate together as one piece, as the external driving means (not shown) rotate drum 102. As these components rotate, free spirals 40 and 50 rotate freely in drums 102 and 110, respectively, as previously described. The remaining components of retort 100, namely, enclosure head 140, inlet pipe 146, outlet pipes 150 and 152, enclosure 160, and the heat supply means remain stationary.

In operation, material, such as solid waste, to be processed by retort 100, enters chamber 148 via inlet pipe 146. As drums 102 and 110 rotate clockwise, fixed spiral 122 pushes the material forward in the direction shown by arrow 126 until the material reaches free rotating spiral 40. Free rotating spiral 40 advances the material in chamber 111 where the material is subjected to the heat supplied in chamber 162 by countercurrently flowing gases 178. Depending on the operation, the temperature of gases 178 may exceed 1600° F. As a result, the waste material is converted to vapors and solids. When the material reaches scoop 112, scoop 112 lifts the material and conveys it to the interior of drum 110 via opening 116. Upon entering drum 110, the material comes into contact with free rotating spiral 50 which advances the material in drum 110 in the direction shown by arrow 156 and towards connector head 140. In the process, hot material flowing in the interior of drum 110 is cooled by exchanging heat indirectly with the cold material flowing countercurrently in chamber 111. After exiting drum 110, the solids flow out of retort 100 by gravity through lower outlet pipe 152, and vapors flow out via upper outlet pipe 150 to a treatment facility (not shown).

Retort 100 shown in FIG. 5 has several advantages over retorts of the prior art. One advantage is that it reduces the number of seals being required to seal the interior of retort 100 from the atmosphere. More particularly, in retort 100, only one seal, namely, seal 42, is required for that purpose. Another advantage is that, in retort 100, seal 142 is in the cold end of retort 100 whereby it is not subjected to failure caused by high temperatures. Still another advantage of retort 100 is that by inserting drum 110 in drum 102, and flowing the material, sequentially, in chamber 111 and the interior of drum 110, the overall length of the retort is reduced without sacrificing heat transfer area. Still another advantage is that retort 100 requires less energy to process the material because its configuration facilitates the heat exchange between the material flowing countercurrently in chamber 111 and drum 110.

(c) Retort with Free Rotating Spirals, Counter-current Chambers, and Hot Vapor Separation Tube.

As described above, as the material being retorted in retort 100 advances in a direction shown by arrow 156 in drum 110, the material exchanges heat with the cold feed entering the left hand side of chamber 111 whereby the material exiting from the left end of drum 110 is cooled. As a result, some of the vapors may condense and may exit retort 100 with the solids via outlet pipe 152. This is undesirable because these condensed vapors may be hazardous. This problem is overcome by an alternative embodiment of the present invention which provides for the separation of the vapors from the solids before the vapors have the opportunity to condense.

Figure 10:
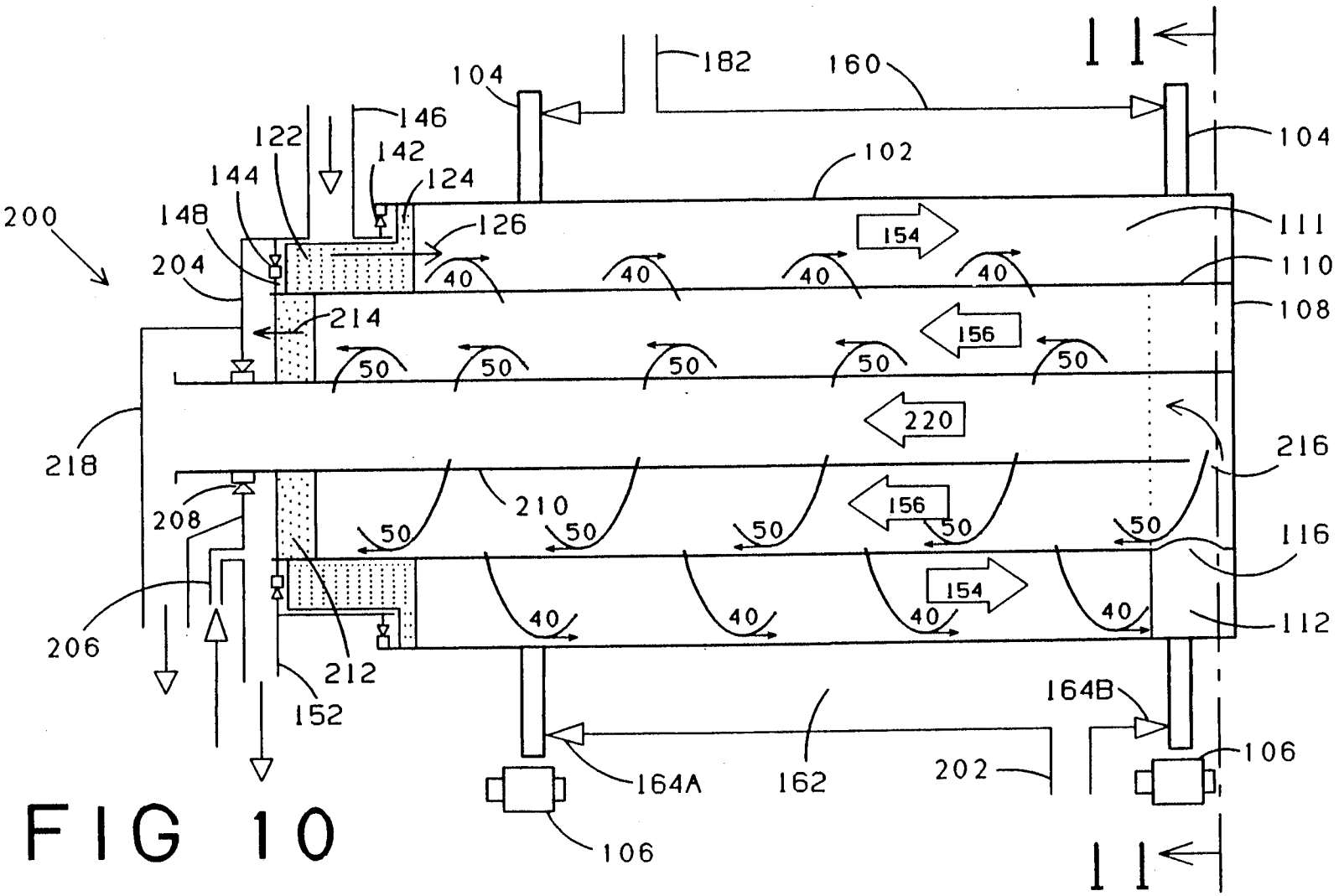
FIG. 10 is a schematic vertical sectional view of another retort according to the present invention.

Referring now to FIG. 10, there is shown retort 200 which allows for the separation of the vapors from the solids prior to being cooled. Retort 200 includes several components which are identical with the components of previously described retort 100. These components are identified herein by the same identification number previously utilized in the description of retort 100. For purposes of simplicity and to avoid unnecessary duplication, those components are not described in detail and reference is made to the pertinent descriptions above.

Retort 200 includes a rotatable exterior drum 102 supported by support rings 104 for rotation. Roller wheels 106 with bearings (not shown) support rings 104. A conventional driving means (not shown) being attached to drum 102 rotates drum 102.

Drum 102 is closed on one end by plate 108. Interior drum 110 is coaxially disposed in drum 102 and forms chamber therebetween. Drum 110 is integrally attached to plate 108 whereby drum 110 rotates together with drum 102.

Immediately adjacent to plate 108, scoop 112 extends from the interior surface of drum 102 to the exterior surface of drum 110. Scoop 112 is a curved baffle which is arranged accordingly so as to lift material from the back end of chamber 111 of drum 102 and to convey such material to the back end of drum 110 through opening 116 of drum 110, as drums 102 and 110 rotate clockwise.

On the left or front end, drum 110 is supported coaxially within drum 102 by fixed spiral 122. The interior circumference of spiral 122 is integrally attached to the exterior circumference of drum 110. Spiral 122 includes increased diameter portion 124 having an exterior circumference being integrally attached to the interior surface of drum 102. The front end of drum 110 and a portion of spiral 122 extend beyond the front end of drum 102. Spiral 122 is comprised of spirally arranged baffles 122A, 122B, 122C, and 122D (not shown in FIG. 10 but shown in FIG. 8) that advance material being processed by retort 200 in the direction shown by arrow 126 as drums 102 and 110 rotate clockwise.

Free rotating spiral 40 is received over drum 110 and is allowed to rotate freely within drum 102, as drums 102 and 110 rotate. Spiral 40 advances material being processed by retort 200 toward the direction shown by arrow 154, as drums 102 an 110 rotate clockwise.

Free rotating spiral 50 is received in the interior of drum 110 and is allowed to rotate freely within drum 110 as drum 110 rotates. Spiral 50 advances the material in the interior of drum 110 in the direction shown by arrow 156, as drum 110 rotates clockwise.

An enclosure 160 encloses drum 102 and forms a heating chamber 162 therebetween. Chamber 162 is sealed from the atmosphere by seals 164A and 164B against support ring 104. A hot gas enters chamber 162 via inlet line 202 and flows over the exterior of drum 102 to provide heat to retort 200. As the hot gas progresses over the exterior of drum 102, it become gradually colder. The cooled gas flows from chamber 162 to the atmosphere via exhaust stack 182.

Retort 200 further includes a connector head 204 which encloses the front end of retort 200. Head 204 has an open end which is inserted between the exterior circumference of the reduced diameter portion of spiral 122 and the interior surface of drum 102. Seal 142 provides a seal between the interior surface of drum 102 and the exterior surface of connector head 204. Seal 144 provides a seal between the interior surface of connector head 204 and the exterior surface of drum 110. Inlet pipe 146 is connected to head 204 to provide an inlet to chamber 148 which is formed between drum 110, head 204, and seals 142 and 144. A lower outlet pipe 152 is connected to head 204 to provide an outlet conduit for solids exiting drum 110, as hereinafter described. A steam injection line 206 is connected to head 204 to provide steam to the front end of drum 110, adjacent to pipe 152.

Connector head 204 further includes an opening 208. A vapor recovery tube 210 is inserted coaxially in drum 110 through free rotating spiral 50. Tube 210 is appropriately sized so as not to impede the operation of spiral 50. Tube 210 is integrally attached to plate 108, on one end, and extends through opening 208 to the exterior of connector head 204, on the other end. A seal seals between opening 208 and tube 210. Adjacent to the open end of drum 110, tube 210 is coaxially supported therein by a fixed spiral 212. The interior circumference of spiral 212 is integrally attached to the exterior circumference of tube 210 and the exterior circumference of spiral 212 is integrally attached to the interior circumference of drum 110. Spiral 212 is comprised of spirally arranged baffles (not shown) which are arranged so as to advance solids in the direction shown by arrow 214 in drum 110, as drum 110 rotates clockwise. Tube 210 includes an opening 216, adjacent to plate 108, for receiving hot vapors from drum 110, as hereinafter described. The portion of tube 210 that extends through opening 208 to the exterior of head 204 is enclosed by collection head 218 which collects vapors from vapor recovery tube 210 and directs them to a treatment area (not shown).

Figure 11:
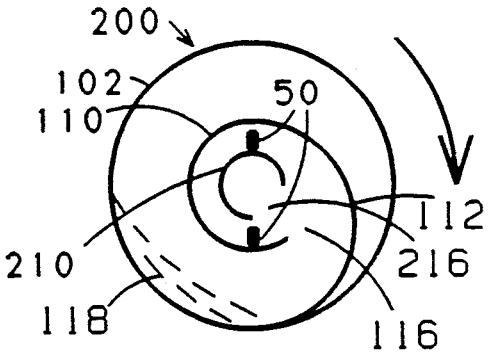
FIG. 11 is a reduced and not to scale cross-sectional schematic of the apparatus of FIG. 10 taken along the plane shown by line 11—11 of FIG. 10 showing the apparatus in one position.

Referring now to FIG. 11, there is shown a schematic cross section of retort 200 taken along line 11—11 of FIG. 10. There is shown tube 210 being coaxially disposed in drum 110, which, in turn, is coaxially disposed in drum 102. Scoop 112 extends from the interior surface of drum 102 to the exterior surface of drum 110. Opening 116 of drum 110 is adjacent to scoop 112 for receiving material 118 being lifted by scoop 112 as drums 102 and 110 rotate clockwise. Opening 216 receives hot vapors from the interior of drum 110. FIG. 11 also shows spiral 50 being disposed in drum 110.

Figure 11A:
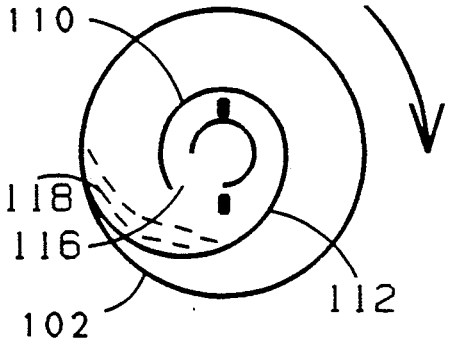
FIG. 11A is reduced and not to scale cross-sectional schematic of the apparatus of FIG. 10 taken along the plane shown by line 11—11 of FIG. 10 showing the apparatus following a ninety-degree rotation from the position shown in FIG. 11.
Figure 11B:
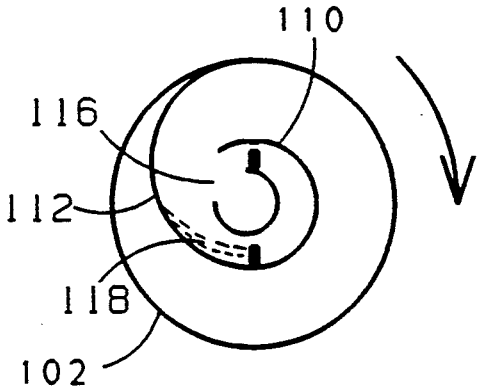
FIG. 11B is a reduced and not to scale cross-sectional schematic of the apparatus of FIG. 10 taken along the plane shown by line 11—11 of FIG. 10 showing the apparatus following a one hundred and eighty degree rotation from the position shown in FIG. 11.

FIGS. 11A and 11B depict a schematic of the cross section of the retort shown in FIG. 11 after one-quarter (ninety-degree) and one-half (one hundred eighty degree) rotations, respectively, showing the progress of material 118 being conveyed from drum 102 into drum 110 by scoop 112 through opening 116, as drums 102 and 110 rotate clockwise.

Referring back to FIG. 10, in operation, drums 102 and 110, tube 210, and fixed spirals 122 and 212 rotate together clockwise as one piece; free rotating spirals 40 and 50 rotate freely in the interior of drums 102 and 110, respectively, as previously described in retort 100; and the remaining components of retort 200 remain stationary. Material such as solid waste enters chamber 148 via inlet pipe 146. As drums 102 and 110 rotate clockwise, fixed spiral 122 pushes the material forward in the direction shown by arrow 126 until such material contacts spiral 40, which, in turn, causes the material to flow in the direction shown by arrow 154 in chamber 111 where the material is subjected to the heat being supplied indirectly by hot gases flowing in chamber 162. Upon exposure to the high temperature being encountered therein, the waste material is converted to vapors and solids. When the material reaches scoop 112, scoop 112 lifts the solids and conveys them to the interior of drum 110 via opening 116.

Hot vapors flow through opening 116 and then through opening 216 into vapor recovery tube 210 where they continue flowing in the direction shown by arrow 220. Vapors exiting tube 210 are collected in collection head 218 and are forwarded to a treatment area.

Upon entering drum 110, the solid material comes into contact with free rotating spiral 50 which advances the material in drum 110 in the direction shown by arrow 156 and toward fixed spiral 212. Fixed spiral 212 flows the material towards connector head 204. In the process, the solids are cooled by exchanging heat indirectly with the cold material flowing countercurrently in chamber 111. After exiting drum 110, the solids flow out of retort 200 by gravity through lower outlet pipe 152. If necessary, steam is injected via line 206 to remove any condensed vapors from the solids prior to exiting retort 200. The steam and the vapors are directed to vapor recovery line 210 for collection and treatment.

Retort 200 has all the advantages of retort 100 listed above. Furthermore, retort 200 has the further advantage of separating the hot vapors from the solids, prior to their being exposed to the cold material flowing countercurrently in chamber 111, whereby the amount of vapor material condensing into the solid is substantially reduced, if not eliminated.

(d) Retort with Free Rotating Spirals, Countercurrent Chambers, Hot Vapor Separation Tube and Carriers Oftentimes, material being processed by the retorts described by the present invention is coked thereby plugging the retort. According to the present invention, retort 200 is modified to provide for the circulation of carriers being circulated in the retort to crush and grind the coked material and to prevent plugging. The carriers are ball or spherical objects made of steel or stone which are small enough to flow between the spirals and the chambers of the retort but large enough to effect crushing and grinding of the coked material.

Figure 12:
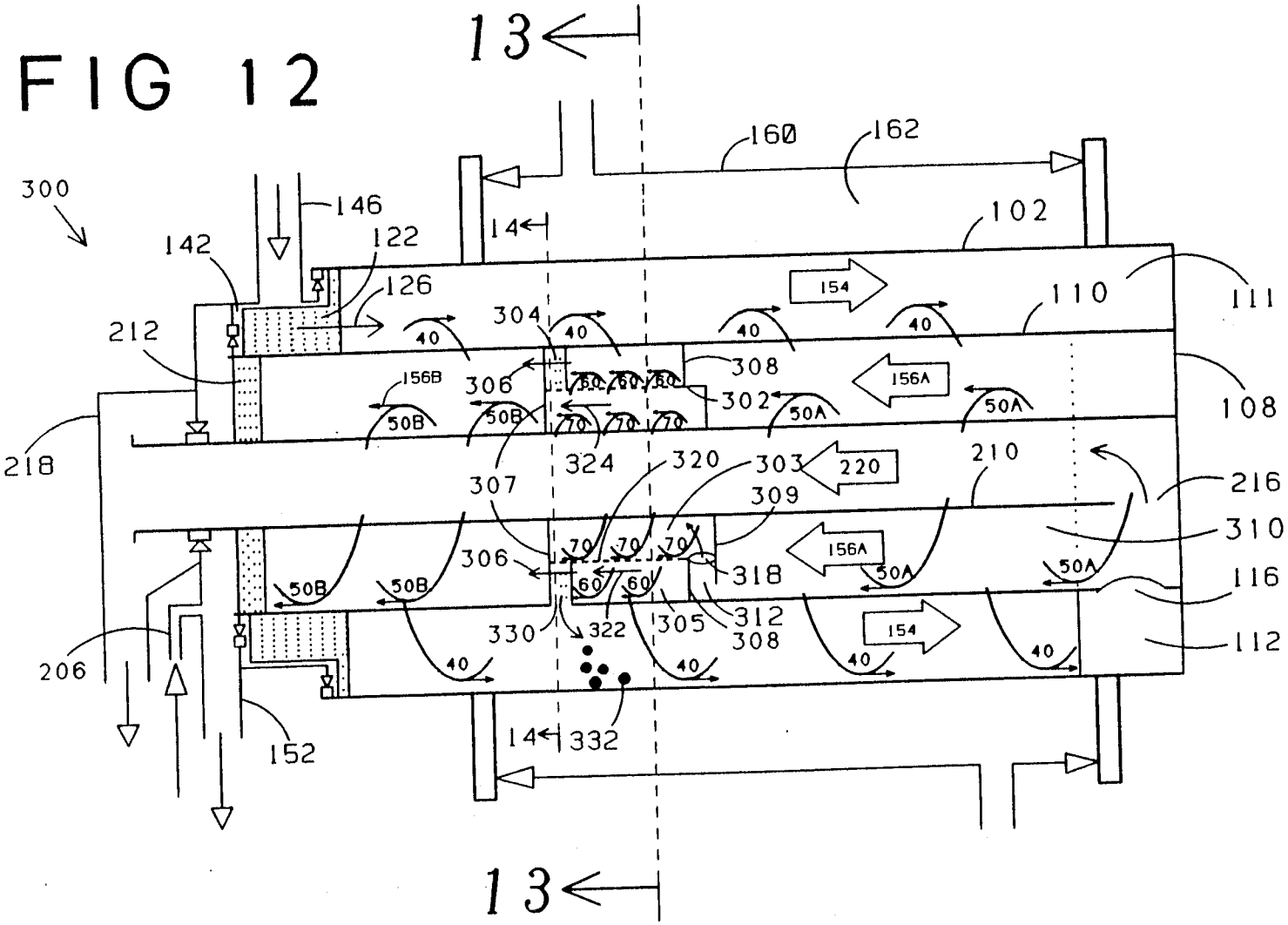
FIG. 12 is a schematic vertical sectional view of another retort in accordance with the present invention.

Referring now to FIG. 12, there is shown retort 300. The components of retort 300 that are the same as the components of retort 200 are identified with the same reference numerals used in the description of retort 200. For purposes of simplicity and to avoid unnecessary duplication, those components are not described in detail and reference is made to the pertinent description above.

Retort 300 is constructed by modifying retort 200 previously described to facilitate the circulation of the carriers. A carrier separation drum 302 is inserted coaxially between interior drum 110 and vapor recovery tube 210 and forms an annular passage 303 between drum 302 and tube 210, and an annular passage 305 between drum 302 and drum 110. The annular ends of drum 302 are closed by plates 307 and 309.

Drum 302 is supported therein by a fixed spiral 304 whose exterior circumference is integrally attached to the interior surface of drum 110. Its interior circumference is integrally attached to the exterior surface of drum 302. Accordingly, drum 302 and spiral 304 rotate as one piece together with tube 210, and drums 110 and 102. Fixed spiral 304 is comprised of spirally arranged baffles 304A, 306B, 304C, 304D, 304E, 304F, 304G, and 304H (shown in FIGS. 14 and 15, but not in FIG. 12) that advance material being processed between drum 110 and drum 302 in the direction shown by arrow 306, as described hereinafter. A circular flange 308 is radially disposed between drums 110 and 302 and forms an annular chamber 310 which extends from flange 308 to plate 108 in drum 110. Immediately adjacent to flange 308, a scoop 312 extends from the interior surface of drum 110 to the exterior surface of drum 302 for lifting material from drum 110 and conveying the same into annular passage 303 via an opening 318, as drums 110 and 302 rotate clockwise.

Drum 302 includes a series of apertures 320 extending radially through its cylindrical wall. Apertures 320 are large enough to allow the gravity flow of crushed material from annular passage 303 to annular passage 305, but small enough to prevent the gravity flow of the carriers from annular passage 303 to annular passage 305.

A free rotating spiral 60 being disposed in chamber 305 and extending from plate 308 to fixed spiral 304 advances material in chamber 305 in the direction shown by arrow 322, as drum 110 rotates clockwise. A free rotating spiral 70 is disposed in chamber 303 and extends from plate 309 to plate 307. Spiral 70 rotates freely in chamber 303 to advance material being processed therein in the direction shown by arrow 324, as drum 302 rotates clockwise.

In retort 300, spiral 50 of retort 200 is replaced by free rotating spirals 50A and 50B. Spiral 50A extends from plate 108 to plate 309. Spiral 50B extends from fixed spiral 304 to fixed spiral 212. Spirals 50A and 50B rotate freely in drum 110 to advance material in the direction shown by arrows 156A and 156B, respectively, as drum 110 rotates clockwise.

Figure 13:
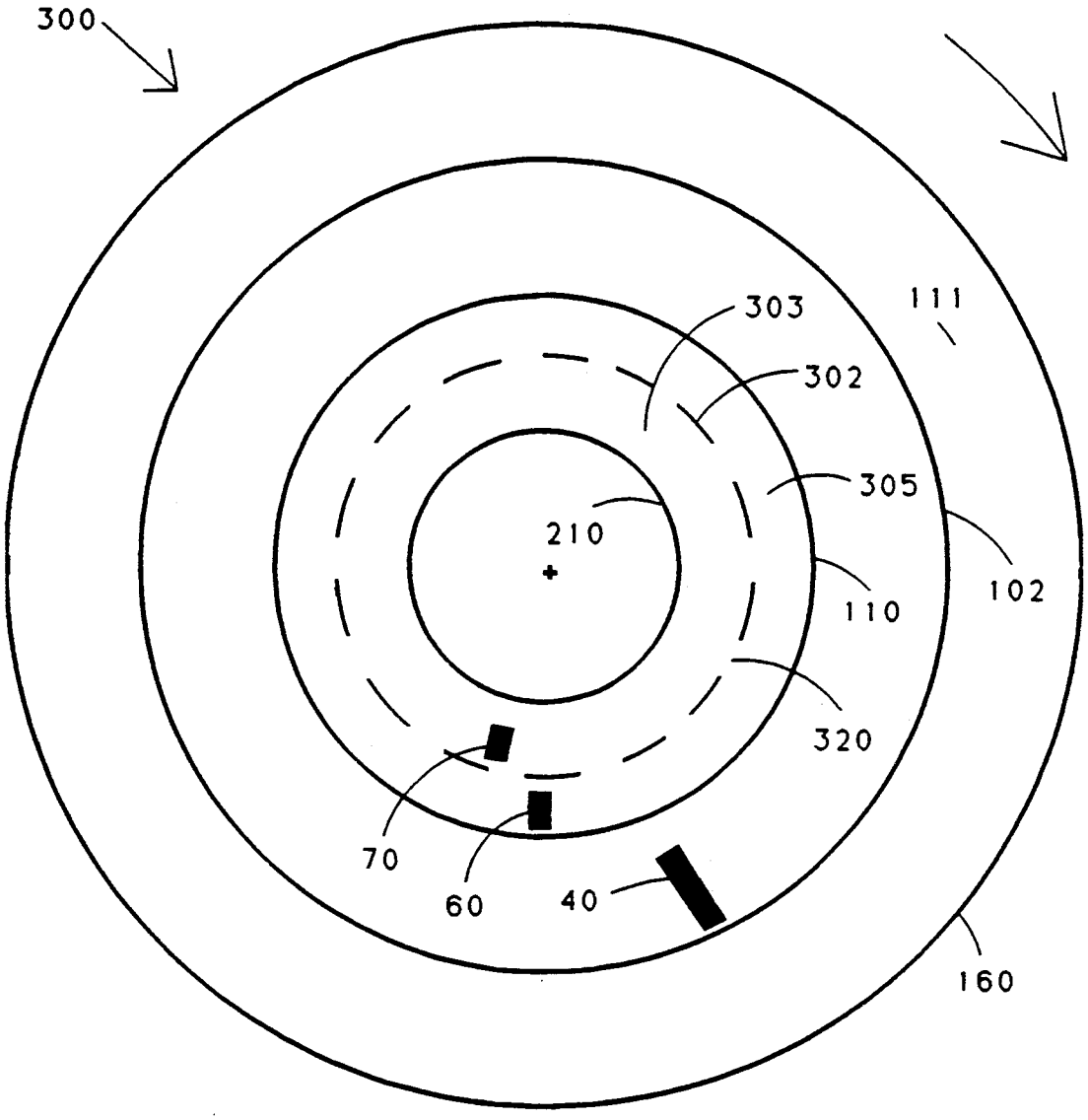
FIG. 13 is enlarged and not to scale cross-sectional schematic of the apparatus of FIG. 12 taken along the plane shown by line 13—13 in FIG. 12.

A cross section of retort 300 taken along line 13—13 of FIG. 12 is shown in FIG. 13. Drum 110 is enclosed by drum 102. Drum 302 having apertures 320 is disposed between tube 210 and drum 110 forming an annular chamber 305 with drum 110, and an annular chamber 303 with tube 210. Free rotating spirals 40, 60 and 70 are disposed in drums 102, 110 and 302, respectively. Drum 102 is enclosed by stationary enclosure 160 which forms chamber 111 therebetween for the flow of hot gas supplying heat to retort 300.

Referring now back to FIG. 12, radial ports 330 extend from chamber 303 to the exterior of drum 110. Ports 330 are isolated from chamber 305, as is better shown in FIGS. 15 and 16. Ports 330 are sufficiently sized to allow the flow of carriers 332 from chamber 303 to the interior of drum 102.

Figure 14:
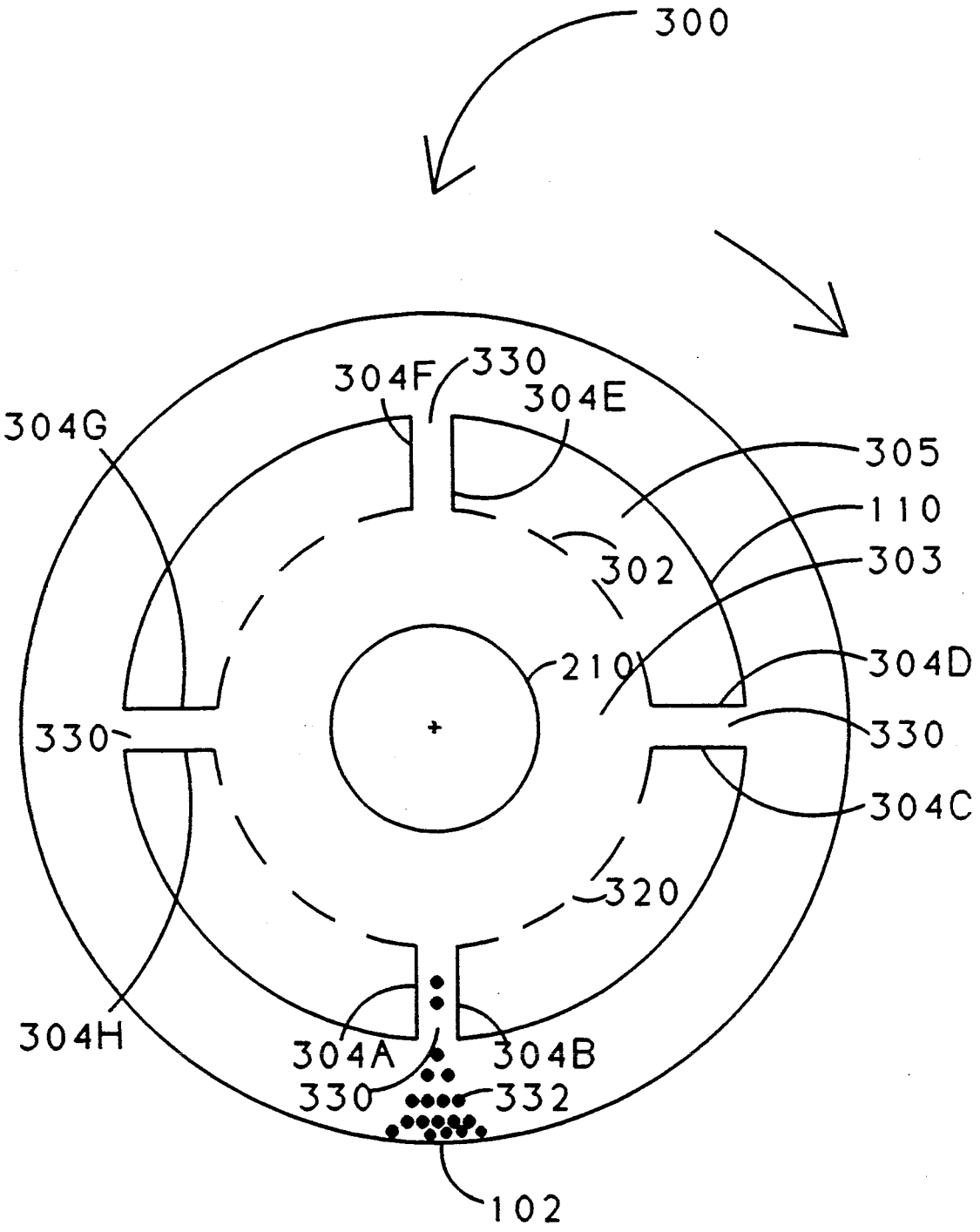
FIG. 14 is an enlarged and not to scale cross-sectional schematic of a section of the apparatus of FIG. 12 taken along the plane shown by line 14—14 in FIG. 12.

FIG. 14 shows a partial cross section of retort 300 along line 14—14 of FIG. 12. The cross section is partial in that it does not show enclosure 160. There is shown carrier separation drum 302 being coaxially disposed between tube 210 and drum 110 and forming chambers 303 and 305. Drum 102 encloses drum 110. Radial ports 330 extend from chamber 303 to the exterior of drum 110. Carriers 332 fall by gravity from chamber 303 into drum 102. Ports 330 extend through, but do not communicate with, chamber 305. The walls of ports 330 are formed by baffles 304A, 304B, 304C, 304D, 304E, 304F, 304G, 304H which constitute fixed spiral 304.

Figure 15:
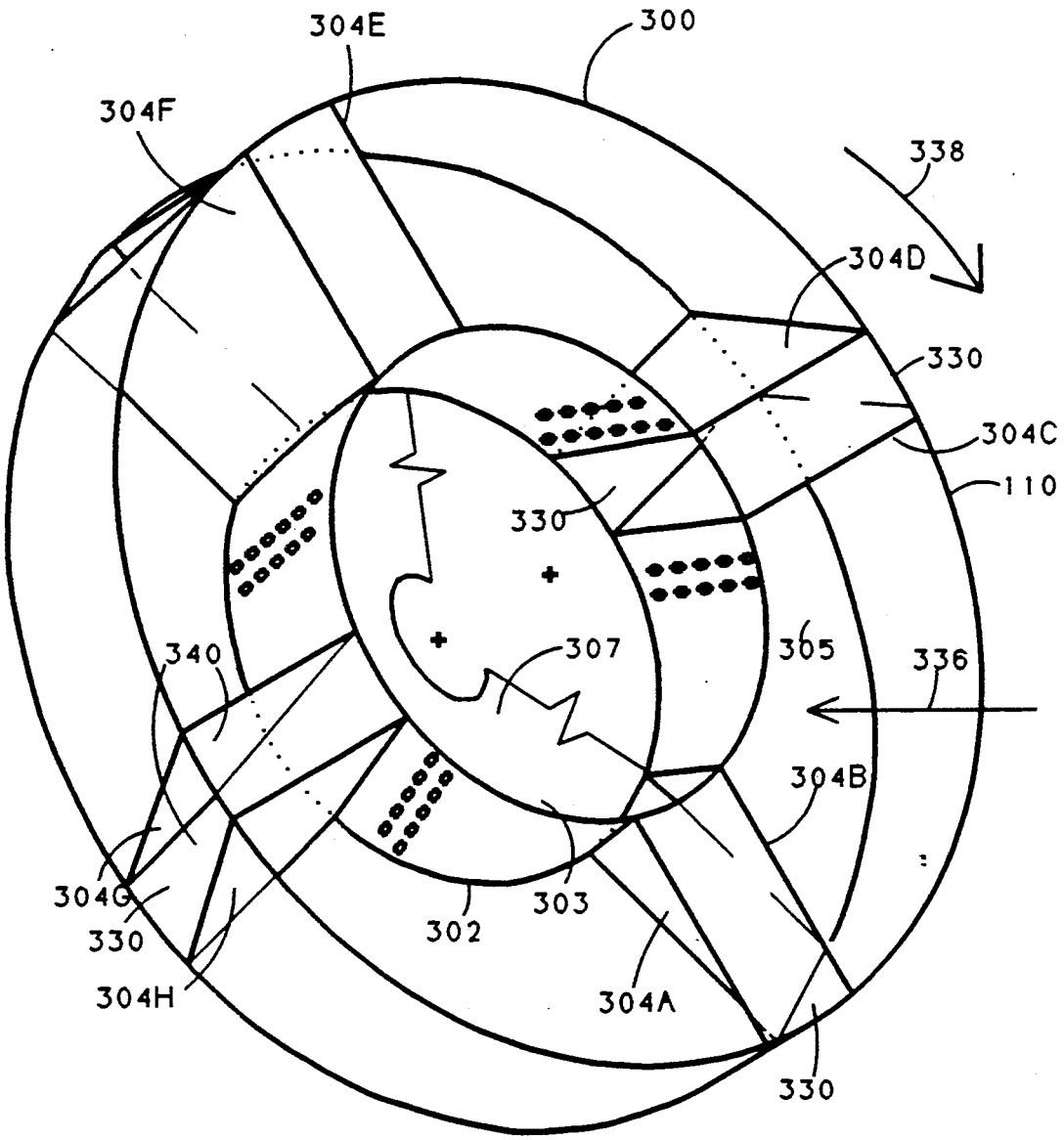
FIG. 15 is ar enlarged and not to scale perspective view of a section of the apparatus of FIG. 12.

Referring now to FIG. 15, there is shown an enlarged isometric view of a section of retort 300 of FIG. 12 to describe the arrangement between drum 110, drum 302, fixed spiral 304, and ports 330 better. Drum 302 is coaxially disposed in drum 110 forming chamber 305 therebetween. A fixed spiral 304 comprised of baffles 304A, 304B, 304C, 304D, 304E, 304F, 304G, and 304H is integrally attached to the exterior of drum 302 and the interior of drum 110. Baffles 304A, 304B, 304C, 304D, 304E, 304F, 304G, and 304H are bent to form a spiral configuration to advance material in chamber 305 in the direction shown by arrow 336, as drums 110 and 302 rotate in the direction shown by arrow 338. The side walls of ports 330 are formed by baffles 304A, 304B, 304C, 304D, 304E, 304F, 304G and 304H and the end walls are formed by plates 340. A portion of plate 307 is also shown closing the annular end of chamber 303.

Referring back to FIG. 12, in operation, drums 102, 110 and 302, fixed spirals 122, 212 and 304 rotate together clockwise as one piece; free rotating spirals 40, 50A, 50B, 60 and 70 rotate freely in their respective chambers. The remaining components of retort 300 remain stationary.

Prior to flowing material to be processed by retort 300, carriers 332 are placed into retort 300 through inlet pipe 146. As the rotating elements of retort 300 rotate clockwise, carriers 332 are advanced by spiral 122 and spiral 40 to scoop 112. Scoop 112 lifts carriers 332 and conveys them to the interior of drum 110 via opening 116. Then, spiral 50A advances carriers 332 in drum 110 in the direction shown by arrow 156A to scoop 312. Scoop 312 lifts carriers 332 and places them through opening 318 into chamber 303. Spiral 70 advances carriers 332 therein until carriers 332 reach ports 330. Carriers 332 fall by gravity through ports 330 back into the interior of drum 102 for recirculation. A sufficient amount of carriers 332 is inserted in retort 300 to break and pulverize coked material formed in the process.

Following the insertion of carriers 332, material such as solid waste flows into chamber 142 via inlet pipe 146. As the rotating components of retort 300 rotate clockwise, fixed spiral 122 advances the solid waste in the direction shown by arrow 126 to contact spiral 40. Then, spiral 40 advances the material in the direction shown by arrow 154 in chamber 111 where the material is subjected to the heat being supplied indirectly by hot gases flowing in chamber 162. Upon exposure to the high temperature encountered therein, the waste material is converted to vapors and solids. In chamber 111, the material is mixed with the recirculating carriers 332 falling through ports 330. Carriers 332 crush the coked solids. When the material and carriers 332 reach scoop 112, scoop 112 lifts the solids and carriers 332 and conveys them to the interior of drum 110 via opening 116. Hot vapors flow through openings 116 and 216 into vapor recovery tube 210. Vapors exiting tube 210 are collected in collection head 218 and are forwarded to a treatment area (not shown).

Spiral 50A advances the solid material and carriers 332 in chamber 310 in the direction shown by arrow 156A to scoop 312. Scoop 312 lifts the solids and carriers 332 and places them in chamber 303 through opening 318. Then, spiral 70 advances the solid material and carriers 332 in the direction shown by arrow 324. The solid material that is now crushed into fine particles by carriers 332 falls through apertures 320 into chamber 305. Carriers 332 are larger than apertures 320 and do not fall through; instead, carriers 332 continue to flow in the direction shown by arrow 324 until they reach ports 330 which are adjacent to plate 307. Carriers 332 fall by gravity back into drum 102 for further recirculation.

The fine solids entering chamber 305 are advanced therein by free rotating spiral 60 in the direction shown by arrow 322 until they reach fixed spiral 304. Spiral 304 causes the material to flow in the direction shown by arrow 306 around the walls of ports 330. Upon exiting spiral 304, the solid material is contacted by spiral 50B which advances the material in the direction shown by arrow 156B towards fixed spiral 212. Then, spiral 212 causes the material to flow out of drum 110 and into lower outlet pipe 152. If necessary, steam is injected via line 206 to remove any condensed vapors from the solids prior to exiting retort 300 and to direct those vapors into vapor recovery line 210 for collection and treatment.

Retort 300 has all the stated advantages of retorts 100 and 200. Furthermore, retort 300 has the further advantage of facilitating a clean and efficient operation by providing recirculating carriers 332 that crush any coked solids that may be formed therein.

(e) Retort with Multiple Drums and Reduced Length

Figure 16:
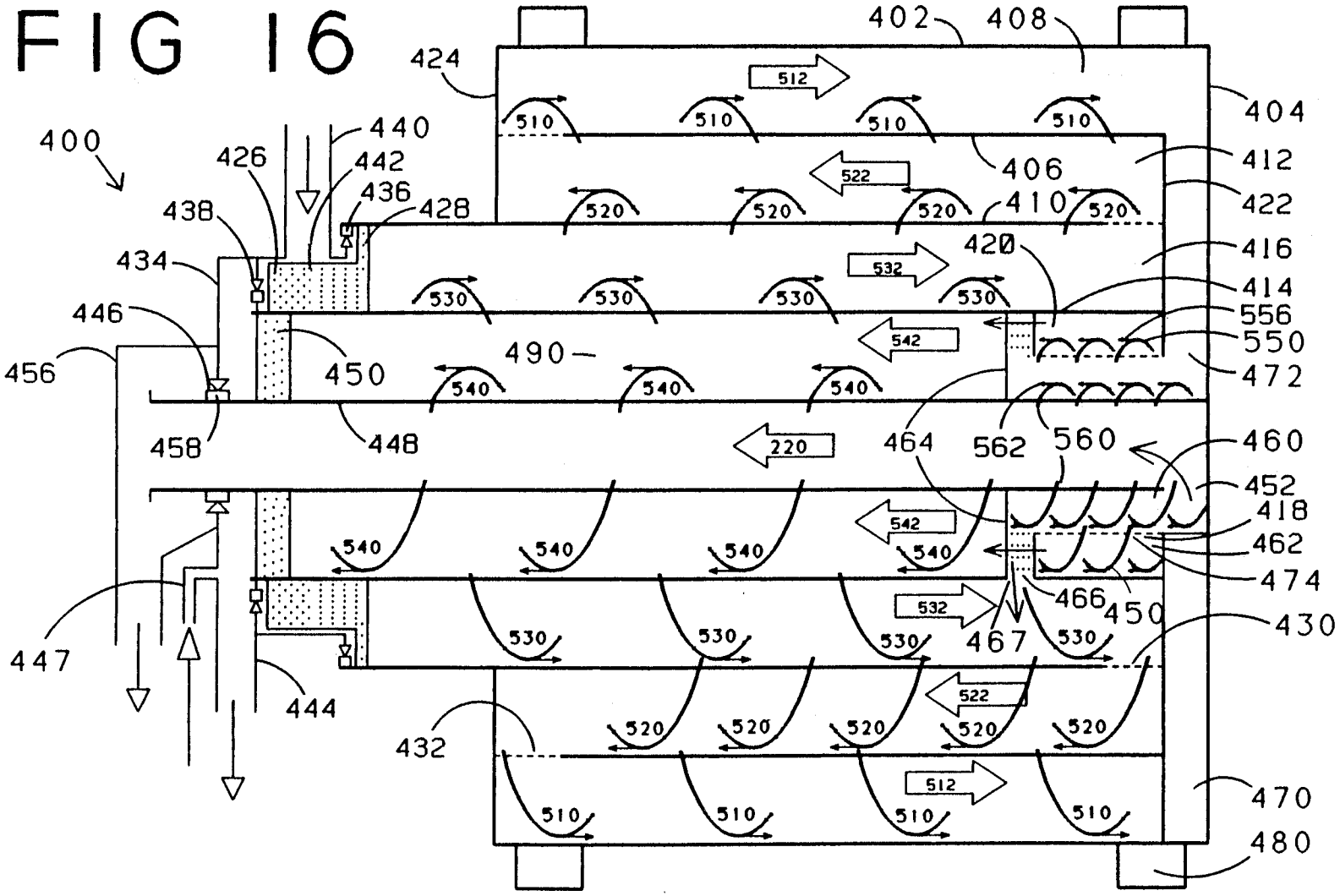
FIG. 16 is a schematic vertical sectional view of another retort according to the present invention.

Although the length of the retorts described above is smaller than the length of the prior art retorts, the overall length of the retort of the present invention may be reduced further by utilizing the free rotating spirals of the present invention in multiple coaxial drums. Referring now to FIG. 16, there is shown a retort 400, utilizing combination of elements described in the retorts above. Retort 400 includes an exterior drum 402 being closed on one end by plate 404. A coaxial first drum 406 is disposed in drum 402 forming a chamber 408 therebetween. A second drum 410 is coaxially disposed inside drum 406 forming a chamber 412 therebetween. A drum 414 is coaxially disposed in drum 410 forming a chamber 416 therebetween. A short carrier separation drum 418 is coaxially disposed in drum 416 and forms a chamber 420 between drum 414 and drum 418. The right-hand ends of drums 406, 410 and 414 are in tandem and a plate 422 that extends from the right-hand end of drum 406 over the right-hand ends of drum 410 and 414 to the exterior surface of drum 418 closes the right-hand ends of chambers 412, 416 and 420.

On the left-hand side, the ends of drums 402 and 406 are in tandem and they are closed by a plate 424 extending from the left end of drum 402 over the left end of drum 406 to the exterior surface of drum 410 thereby closing the left annular ends of chambers 408 and 412.

The left end of drum 410 extends beyond plate 424 and the left end of drum 414 extends beyond the left end of drum 410. On the left end, drum 414 is supported inside drum 410 by a fixed spiral 426 which is similar to the fixed spiral 122 previously described in retort 100. Fixed spiral 426 has an increased diameter portion 428 whose exterior circumference is rigidly attached to the interior surface of drum 410. The interior circumference of fixed spiral 426 is rigidly attached to the exterior surface of drum 414. Drum 410 has perforations 430 immediately adjacent to plate 422, and drum 406 has perforations 432 immediately adjacent to plate 424.

Retort 400 further includes a connector head 434 which encloses the front end of retort 400. Head 434 which is similar to head 204 of retort 200 has an open end which is inserted between the exterior circumference of the reduced diameter portion of spiral 426 and the interior surface of drum 410. Seal 436 provides a seal between the interior surface of drum 410 and the exterior surface of connector head 434. Seal 438 provides a seal between the interior surface of connector head 434 and the exterior surface of drum 414. An inlet pipe 440 is connected to head 434 to provide an inlet to chamber 442 which is formed between drum 414, head 434, and seals 436 and 438. A lower outlet pipe 444 is connected to head 434 to provide an outlet conduit for solids exiting drum 414, as hereinafter described. A steam injection line 447 is connected to head 434 to provide steam to the front of drum 414, adjacent to pipe 444.

Connector head 434 further includes an opening 446. A vapor recovery tube 448 is inserted coaxially in drum 418. Tube 448 is integrally attached to plate 404, on one end, and extends through opening 446 to the exterior of connector head 434, on the other end. Adjacent to the open end of drum 414, tube 448 is coaxially supported therein by a fixed spiral 450 which is similar to previously described spiral 212 of FIG. 12. The interior circumference of spiral 450 is integrally attached to the exterior circumference of tube 448 and the exterior circumference of spiral 450 is integrally attached to the interior surface of drum 414.

Tube 448 includes an opening 452 adjacent to plate 404 for receiving hot vapors from chambers 408 and the interior of drum 418, as hereinafter described. The portion of tube 448 that extends through opening 446 to the exterior of head 434 is enclosed by collection enclosure 456 which collects vapors from vapor recovery tube 448 and directs them to the treatment area. Seal 458 provides a seal between opening 446 and the exterior surface of tube 448.

Carrier separation drum 418 is similar to carrier separation drum 302 previously described in FIG. 12. Carrier separation drum 418 forms an annular passage 460 between tube 448 and drum 418, and an annular passage 462 between drum 418 and drum 414. The right end of drum 418 is closed by plate 404. The left end of drum 418 is closed by a plate 464.

The left end of drum 418 is supported within retort 400 by a fixed spiral 466 which is similar to fixed spiral 304 previously described in FIGS. 12, 14 and 15. The exterior circumference of fixed spiral 466 is integrally attached to the interior surface of drum 414, and the interior circumference of fixed spiral 466 is integrally attached to the exterior surface of drum 418.

Drum 418 includes a series of apertures 474 extending radially through its cylindrical wall. Apertures 474 are large enough to allow the gravity flow of crushed material from annular passage 460 to annular passage 462 but small enough to prevent the gravity flow of the carriers from annular passage 460 to annular passage 462. Ports 467 extend radially from chamber 460 to chamber 416 for facilitating the flow of the carriers from chamber 460 to chamber 416. It should be understood that ports 467 are similar to ports 330 previously described in FIGS. 12, 14 and 15.

A scoop 470 extends from the interior surface of drum 402 to the exterior surface of drum 418 and between plates 404 and 422. Scoop lifts solid material from drum 402 and conveys the same into annular passage 460 in drum 418 via opening 472 while the drums rotate clockwise. Scoop 470 is similar to scoop 112 previously described in retorts 100, 200 and 300.

Drum 402 is supported by roller means 480. Heating means (not shown) similar to the ones previously described in connection with retorts 100, 200 and 300 supply hot gases around the exterior surface of drum 402.

Because they are integrally connected, drums 402, 406, 410, 414 and 418, vapor tube 448, and fixed spirals 428, 450 and 466 rotate as one piece, while connector head 434 and enclosure 456 remain stationary. External driving means (not shown) rotate drum 402 and the aforementioned rotating components clockwise.

Several free rotating spirals are utilized to advance the material inside retort 400. A free rotating spiral 510 is disposed in chamber 408 and is configured to advance solid material in chamber 408 in the direction shown by arrow 512. A free rotating spiral 520 is disposed in chamber 412 and is configured to advance material in chamber 412 in the direction shown by arrow 522. A free rotating spiral 530 is disposed in chamber 416 to rotate freely to advance material therein in the direction shown by arrow 532. A free rotating spiral 540 is disposed in chamber 490 formed between tube 448 and drum 414 to advance solid material in the direction shown by arrow 542. A free rotating spiral 550 is disposed in chamber 462 to advance material in the direction shown by arrow 556. Finally, a free rotating spiral 56C is disposed in chamber 460 to advance material in the direction shown by arrow 562.

Prior to flowing material for processing in retort 400, a predetermined volume of carriers is inserted in retort 400 through pipe 440. As the rotating elements of retort 400 rotate clockwise the carriers are advanced, in sequence, by fixed spiral 426, and free rotating spiral 530 to the end of chamber 416 where they fall through perforations 430 to chamber 412. Spiral 520 pushes them towards the left end of chamber 412 where they fall through perforations 432 to chamber 408. Therein, they are advanced by free rotating spiral 510 to scoop 470. Scoop 470 lifts the carriers and conveys them to chamber 460 through opening 472 where they are advanced by spiral 560 until they fall back into chamber 416 through ports 466 for recirculation.

Material to be treated by retort 400 is injected therein via pipe 440. The material is advanced, in sequence, by fixed spiral 426 and free rotating spiral 530 to the end of chamber 416 where they fall to chamber 412 via perforations 430. Prior to falling through perforations 432, the material is mixed with carriers falling through ports 467. In chamber 412, the material/carrier mixture is advanced by free rotating spiral 520 to the end thereof where the mixed carriers and material fall into chamber 408 via perforations 432. Spiral 510 advances the mixture to scoop 470. By now, the material has been separated to solids and vapors as a result of its exposure to the high temperature. Scoop 470 lifts the solids and the carriers and conveys them to chamber 460 through opening 472.

The carriers crush and grind the material. The crushed solids falls into chamber 462 from chamber 460 via apertures 474. In chamber 462, they are advanced by spiral 550 to fixed spiral 466. Spiral 466 advances the solids to chamber 490 where they are pushed by spiral 540 and fixed spiral 450 to head 434. Then, the solids flow out from retort 400 via pipe 444 by gravity. The vapors formed in retort 400 flow into vapor recovery tube 448 via opening 452 and are collected in enclosure 456 for treatment.

The use of the multiple coaxial drums as shown in retort 400 decreases the overall length of the retort and improves the thermal efficiency of the retort because of the countercurrent flow of the material. It should be understood that the number of coaxial drums may be increased to further reduce the overall length and to increase the thermal efficiency.

(f) Extruder for Processing Solids Exiting Retort

Figure 17:
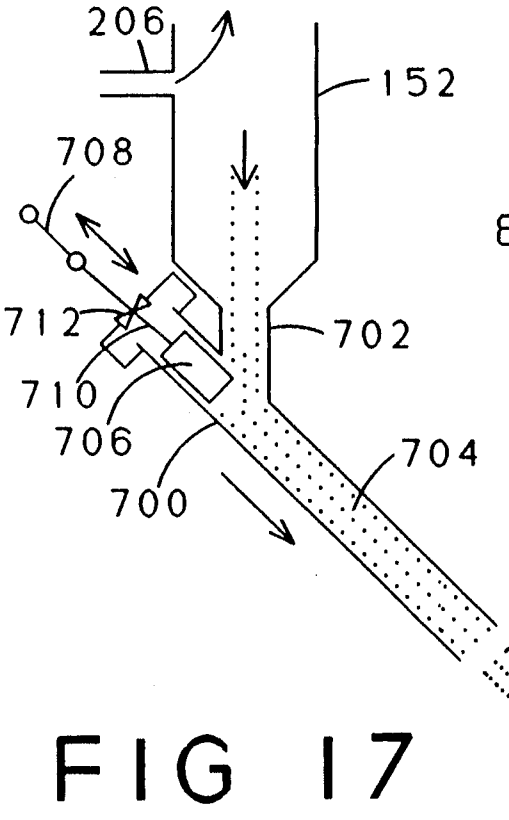
FIG. 17 is a schematic vertical sectional view of an extruder that can be used together with the retorts of the present invention and other retorts.

Although several methods can be utilized for the preparation of the solid material exiting the retorts described herein for disposal, reference is now made to FIG. 17 showing an apparatus for packing the solid material to briquettes which are free of vapors prior to said material being exposed to the atmosphere. FIG. 17 shows an extruder 700 being attached to outlet pipe 152 of retort 200. Extruder 700 includes a vertical extruder feed line 702 which feeds solids from outlet pipe 152 to sloped extruder tube 704. A reciprocating piston 706 is disposed in extruder tube 704 and reciprocates along the axis of extruder tube 704. Piston 706 is driven by driving means 708 which is attached to piston 706 via piston rod 710. Packing 712 or other similar means are provided around piston rod 710 to prevent the escape of vapors from extruder feed tube 702 into the atmosphere. If required, steam may be injected in outlet pipe 152 via steam injection line 206 to remove undesirable vapors from the solids and flow them back to retort 200 (not shown).

In operation, solids fall from outlet pipe 152 into extruder tube 704 via extruder feed line 702. Piston 706 applies pressure against those solids to compact and compress the same. During such compression, most of the vapors that are entrained into the solids are removed from the solids and flow back into retort 200. As the compressed solids are being advanced in extruder tube 704, piston 706 is retracted to make space for additional solids for further compression. The solids exiting extruder tube 704 fall off the end thereof as briquettes 716, as shown.

(g) Apparatus for Supporting and Rotating Drums in Retorts

Reference is now made back to FIG. 5. Metal seal 164B providing a seal between enclosure 160 and roller 104 is exposed to high temperature and is, therefore, subjected to failure. According to an alternative embodiment of the present invention, unique and novel means that do not require seal 164B are used to rotate the retorts.

Figure 18:
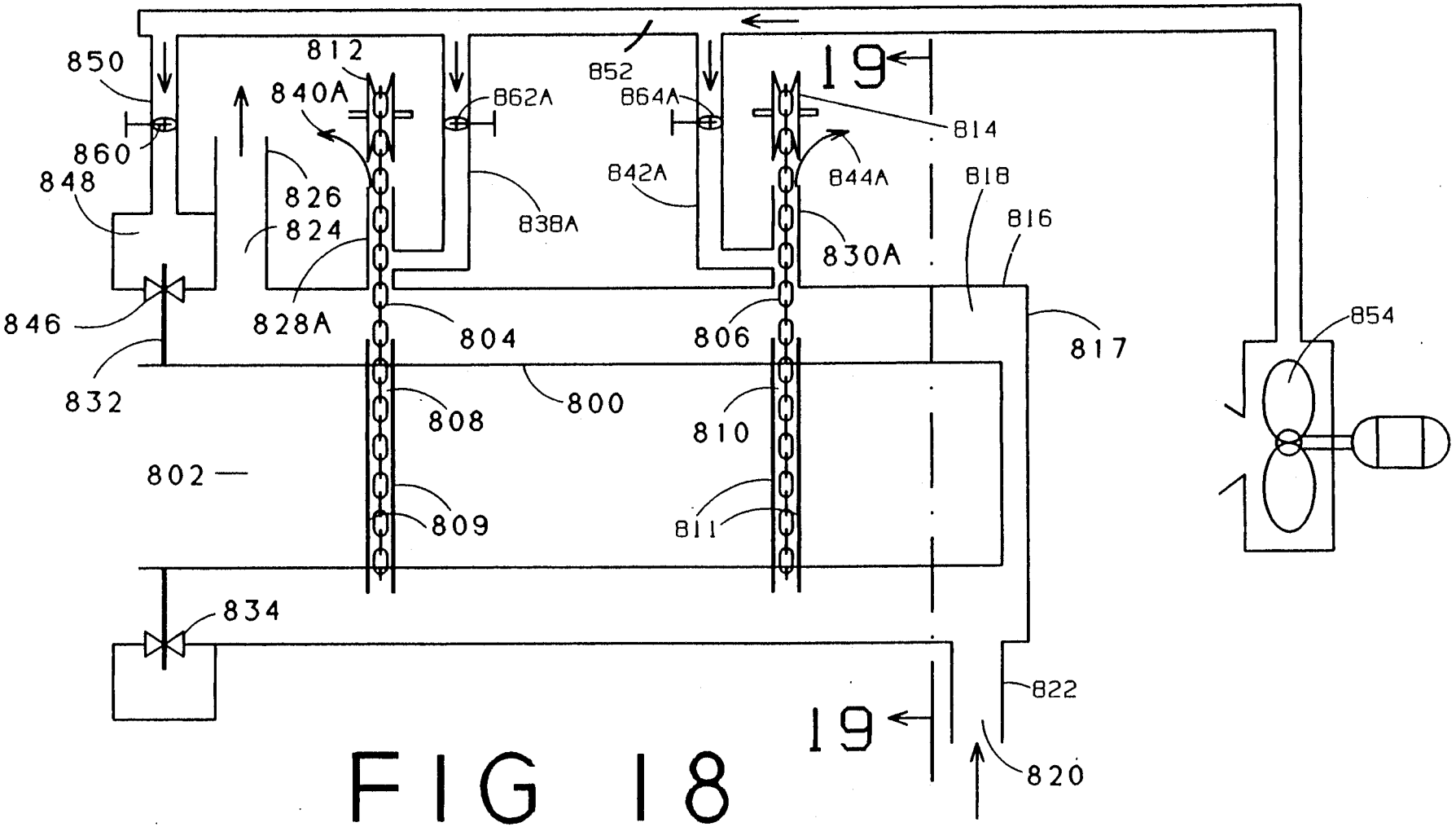
FIG. 18 is schematic vertical sectional, partially elevational, view of an apparatus for rotating the retorts of the present invention.

Referring now to FIG. 18, there is shown a side view of a schematic of a horizontal exterior drum 800. Drum 800 can be any exterior drum of the retorts previously described, i.e., drum 102 of retorts 100, 200 and 300 or drum 402 of retort 400. Material enters in and exists from left side 802 of the retorts, as previously described in the aforementioned retorts. Drum 800 is supported and rotated by closed loop chains 804 and 806. Chains 804 and 806 are received over the exterior circumference of drum 800 in circumferential exterior channels 808 and 810, respectively. Channel 808 is formed by rings 809 and channel 810 is formed by rings 811. Chain 804 is supported and rotated by wheel means, such as a cogwheel 812, and chain 806 is similarly supported and rotated by cogwheel 814. Cogwheels 812 and 814 are well known in the art and no further description is necessary.

An enclosure 816 is received over drum 800 and forms a chamber 818 therebetween. Enclosure 816 fully encloses the right side of drum 800 by plate 817. A hot gas 820 flows into chamber 818 via inlet pipe 822 and flows around the exterior of drum 800 to treat the material processed in drum 800. After heating drum 800, the hot gas is cooled and exits chamber 818 as cold gas 824 through exhaust stack 826.

Enclosure 816 has tubes 828A and 828B (tube 828B is not shown) for providing a passage for chain 804 through the wall of enclosure 816. Similarly, enclosure 816 has tubes 830A and 830B (tube 830B is not shown) for allowing the passage of chain 806 through the walls of enclosure 816.

A circular flange is received over the left end of drum 800, which is the cold end, and closes the left end of chamber 818. A seal 834 provides a seal between flange 832 and enclosure 816 for containing the heating medium used to heat drum 800.

Cold air under pressure is supplied to tubes 828A via tube 838A to cool chain 804 and to provide a pressurized blanket in tube 828A to prevent the escape of hot gas from chamber 818. After chain 804 is cooled, the compressed air flows out of tube 828A, as shown by arrow 840A. Tube 842A similarly supplies tube 830A with cold air to cool chain 806 and to prevent the escape of hot gases from chamber 818 through tube 830A. After cooling chain 806, the pressurized air flows out of tube 830A as shown by arrow 844A.

Because mechanical seal 834 is not foolproof, a secondary seal 846 is provided between flange 832 and enclosure 816 by supplying compressed air into chamber 848 via tube 850. Tubes 838A, 842A and 850 are connected to a distribution header 852 which receives cold compressed air from fan 854.

Manually operated damper valves 860, 862A, 862B (not shown), 864A, and 864B (not shown) are placed in tubes 850, 838A, 838B (not shown), 842A, and 842B (not shown), respectively. Damper valves 860, 862A, 862B, 864A, and 864B are manually adjusted to equalize the pressure of the compressed air flowing in the respective tubes 850, 838A, 838B, 842A, and 842B so that cold air does not flow into chamber 818 and hot gases from chamber 818 do not flow into tubes 850, 828A, 828B, 830A and 830B.

It should be understood that, in the apparatus shown schematically in FIG. 18, tubes 838A and 838B (tube 838B is not shown) are on the same plane with cogwheel 812 and chain 804. Similarly, tubes 842A and 842B (tube 842B is not shown) are on the same plane with cogwheel 814 and chain 806. For simplicity purposes, however, and because FIG. 18 is merely a schematic representation of the apparatus, tube 838A is not shown as being on the same plane with cogwheel 812 and chain 804, and tube 842A is not shown as being on the same plane with cogwheel 814 and chain 806.

Figure 19:
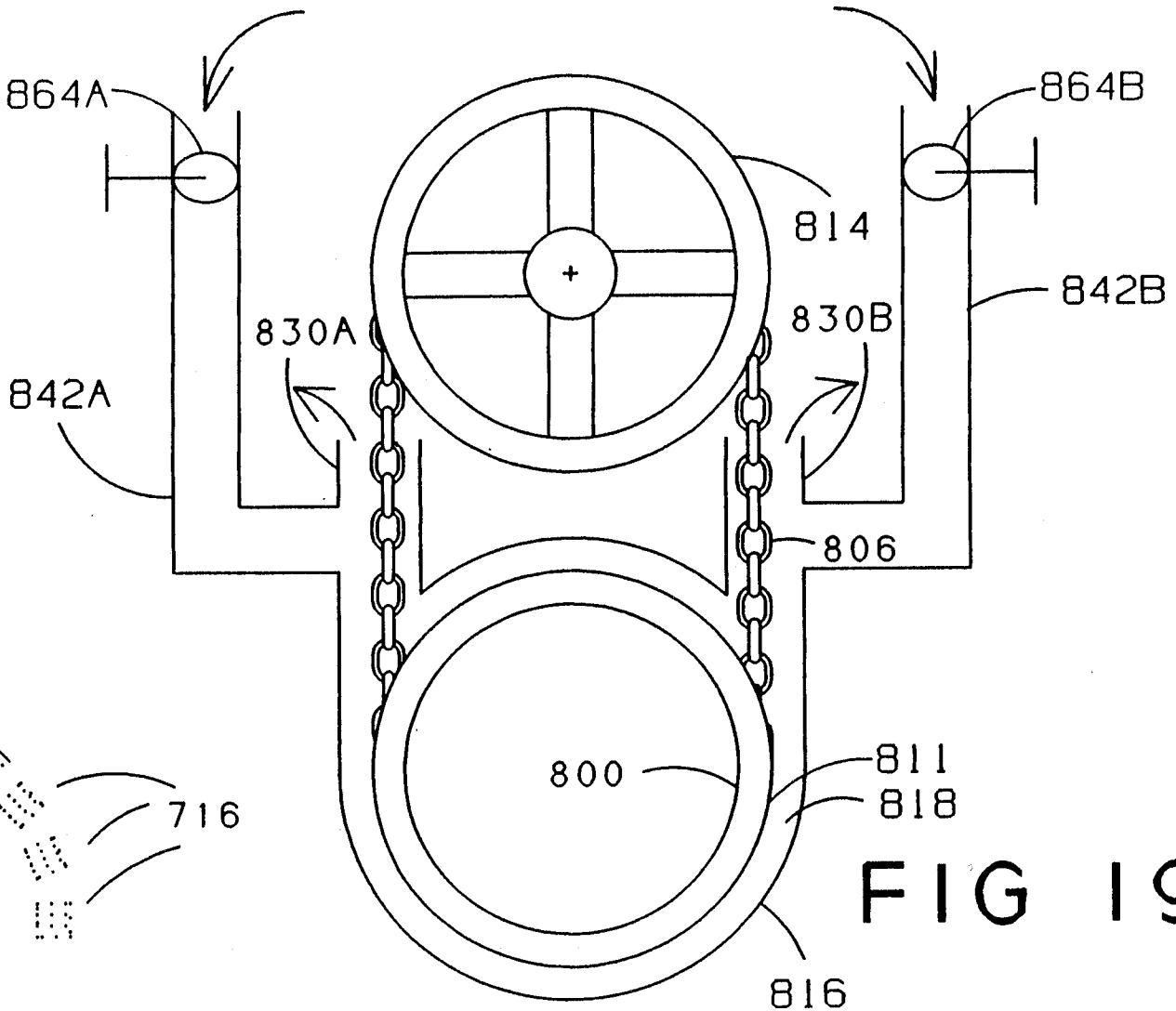
FIG. 19 is ar enlarged and not to scale cross-sectional, partially elevational, schematic of the apparatus shown in FIG. 18 taken along the plane shown by line 19—19 in FIG. 18.

Reference now is made to FIG. 19 showing a schematic cross-section of FIG. 16 taken along lines 19—19 of FIG. 18. There is shown drum 800 being enclosed by enclosure 816. Chain 806 is received over drum 800 and is prevented from axially slipping thereon by rings 811. Chain 806 extends exteriorally of enclosure 816 through tubes 830A and 830B and is received over cogwheel 814 which supports and rotates chain 806. Compressed air is supplied to tube 830A via tube 842A and to tube 830B via tube 842B. Tubes 842A and 842B are connected to header 842 (not shown). The compressed cold air provides a pressurized blanket in tubes 830A and 830B to cool chain 806 and to prevent the escape of hot gases from chamber 818.

Cogwheel 814 rotates chain 806 which, in turn, rotates drum 800. Drum 800 can be the exterior drum of any of the retorts previously described or any modifications thereof. Accordingly, although the internals of drum 800 are not described, reference is made to the previous descriptions of retorts 100, 200, 300 and 400. Any of those retorts can be rotated as disclosed herein by utilizing chains 804 and 806 wherein those chains are received over the exterior drums of said retorts. Furthermore, any other retorts can be supported and rotated as disclosed herein by such chains.

Any waste or nonwaste material containing solids and liquids and requiring the separation of the liquids from the solids by vaporizing the liquids through exposure to heat can be treated and processed by the retorts disclosed by the present invention. Examples of such material include sewage sludge and hazardous waste. Because of the advantages listed above, the use of the above retorts is highly desirable in situations wherein the treatment requires very high temperatures which, sometimes, exceed 1500° F.

While preferred embodiments of the present invention have been shown and described, modifications thereof can be made by one skilled in the art without departing from the spirit of the invention.

What is claimed is:

1. An apparatus for the processing of material, comprising:

a rotatable first drum having a first drum first end and a first drum second end;

a second drum disposed in the interior of the first drum and integrally attached to the first drum so that the second drum is rotatable together with the first drum, the second drum having a second drum first end and a second drum second end;

inlet means for flowing unprocessed material into the first drum;

outlet means for removing processed material from the second drum, the outlet means being sufficiently independent of the inlet means so as to prevent contacting the processed material flowing out of the second drum with the unprocessed material flowing into the first drum;

a freely rotatable helical element disposed in the first drum and encircling the second drum, the helical element being freely rotatable in the first drum and around the second drum as the first drum rotates for advancing the material in the first drum in a first direct;

means for conveying the material from the first drum to the second drum; and means for advancing the material in the second drum in a direction countercurrent to the first direction.

2. An apparatus according to claim 1 further including a plate for closing the first drum second end and the second drum second end.

3. An apparatus according to claim 1 wherein the means for advancing the material in the second drum is a fixed spiral.

4. An apparatus according to claim 1 wherein the conveying means includes a scoop.

5. An apparatus according to claim 1 further including means for rotatably supporting the first drum.

6. An apparatus according to claim 1 further including means for rotating the first drum.

7. An apparatus according to claim 1 further including means for providing heat to the first drum.

8. An apparatus according to claim 1 further including a connector head connected to the first drum and to the second drum.

9. An apparatus according to claim 8 further including a first seal for sealing between the connector head and the first drum and a second seal for sealing between the connector head and the second drum.

10. An apparatus according to claim 1 wherein the advancing means for advancing the material in the second drum further includes a freely rotatable spiral disposed in the second drum.

11. An apparatus for the thermal processing of material, comprising:

a rotatable first drum having a first drum first end and a first drum second end;

a second drum disposed in the interior of the first drum and integrally attached to the first drum so that the second drum is rotatable together with the first drum, the second drum having a second drum first end and a second drum second end;

inlet means for flowing material into the first drum;

outlet means for removing material from the second drum;

means for advancing the material first in the first drum, and then, in the second drum, the advancing means including a first freely rotatable spiral disposed in the first drum and encircling the second drum and a second freely rotatable helical element disposed in the second drum; and heating means for providing heat to the first drum.

12. An apparatus for the processing of material, comprising:

a rotatable first drum having a first drum first end and a first drum second end;

a second drum disposed in the interior of the first drum and integrally attached to the first drum so that the second drum is rotatable together with the first drum, the second drum having a second drum first end and a second drum second end;

a connector head connected to the first drum and to the second drum;

inlet means for flowing unprocessed material into the first drum, the inlet means including a first opening in the connector head;

outlet means for removing processed material from the second drum, the outlet means being sufficiently independent of the inlet means so as to prevent contacting the processed material flowing out of the second drum with the unprocessed material flowing into the first drum, the outlet means including a second opening in the connector head; and means for advancing the material first in the first drum in a first direction, and then, in the second drum in a direction countercurrent to the first direction, the advancing means including a spiral.

13. An apparatus for the treatment of material, comprising:

a rotatable first drum having a first drum first end and a first drum second end;

a second drum rigidly connected to the first drum and disposed in the interior of the first drum to form a first chamber therebetween, the second drum having a second drum first end and a second drum second end;

inlet means for flowing material to the first drum first end;

a freely rotatable spiral disposed in the chamber and encircling the second drum for flowing material from the first drum first end to the first drum second end;

means for conveying material from the first drum second end to the second drum second end; and means for moving material from the second drum second end to the second drum first end; and outlet means for removing material from the second drum first end.

14. An apparatus for the treatment of material, comprising:

a rotatable first drum having a first drum first end and a first drum second end;

a second drum rigidly connected to the first drum and disposed in the interior of the first drum to form a first chamber therebetween, the second drum having a second drum first end and a second drum second end;

inlet means for flowing unprocessed material to the first drum first end;

outlet means sufficiently independent of the inlet means for removing processed material from the second drum first end without contacting the processed material flowing out of the second drum with the unprocessed material flowing to the first drum first end; and means for advancing the material from the first drum first end to the second drum first end; and means for heating the exterior of the first drum.

15. An apparatus according to claim 14 further including:

a stationary connector head connected to the first drum and to the second drum;

a first seal for sealing between the connector head and the first drum; and a second seal for sealing between the connector head and the second drum;

the first seal allowing the rotation of the first drum and the second seal allowing the rotation of the second drum with respect to the connector head.

16. An apparatus according to claim 14 wherein the advancing means includes:

means for flowing material from the first drum first end to the first drum second end;

means for conveying material from the first drum second end to the second drum second end; and means for moving material from the second drum second end to the second drum first end.

17. An apparatus according to claim 16 wherein the flowing means includes a fixed spiral connected to the first drum.

18. An apparatus according to claim 16 wherein the conveying means includes a scoop.

19. An apparatus according to claim 18 wherein the second drum includes an opening and the scoop directs the material to the opening.

20. An apparatus according to claim 16 wherein the moving means includes a freely rotatable helical element disposed in the interior of the second drum.

21. An apparatus according to claim 14 further including means for rotating the first drum.

22. An apparatus according to claim 16 wherein the flowing means includes a freely rotatable spiral disposed in the chamber.

23. An apparatus for the treatment of material comprising:

a rotatable first drum having a first drum first end and a first drum second end;

a second drum rigidly connected to the first drum and disposed in the interior of the first drum to form a first chamber therebetween, the second drum having a second drum first end and a second drum second end;

inlet means for flowing material to the first drum first end;

means for advancing the material from the first drum first end to the second drum first end;

a tube disposed in the second drum and attached to either the first drum or the second drum to form a flow passage between the tube and the second drum, the tube having an opening for providing communication between the second drum and the tube and a tube outlet for flowing material from the interior of the second drum to the exterior of the second drum; and outlet means for removing material from the second drum first end.

24. An apparatus according to claim 23 wherein the advancing means includes:

a freely rotatable spiral disposed in the flow passage; and a fixed spiral disposed in the flow passage in series with the freely rotatable spiral and integrally attached to the second drum.

25. An apparatus according to claim 23 further including:

a stationary connector head connected to the first drum, the second drum and the tube;

a first seal for sealing between the connector head and the first drum;

a second seal for sealing between the connector head and the second drum;

a third seal for sealing between the connector head and the tube; and a steam injection line for injecting steam into the outlet means.

26. An apparatus according to claim 23 further including:

a carrier separation drum disposed between the second drum and the tube and forming a first passageway between the tube and the carrier separation drum and a second passageway between the carrier separation drum and the second drum;

first communication means providing communication between the flow passage and the second passageway;

second communication means for providing communication between the first passageway and the second passageway;

third communication means for providing communication between the first passageway and the first chamber;

first flowing means for flowing a portion of the material in the second passageway; and second flowing means for flowing a portion of the material in the first passageway.

27. An apparatus according to claim 26 wherein:

the second flowing means includes a first free rotating helical element and a fixed helical element in series; and the third communication means includes a member having a port therethrough, the port extending from the first passageway to the first chamber.

28. An apparatus for the treatment of material, comprising:

a rotatable first drum having a first drum first end and a first drum second end;

a second drum rigidly connected to the first drum and disposed in the interior of the first drum to form a first chamber therebetween, the second drum having a second drum first end and a second drum second end;

a third drum disposed over the first drum and forming a second chamber therebetween;

a fourth drum disposed over the third drum and forming a third chamber therebetween;

inlet means for flowing unprocessed material to the first drum first end;

outlet means sufficiently independent of the inlet means for removing processed material from the second drum first end without contacting the processed material flowing out of the second drum with the unprocessed material flowing to the first drum first end; and means for advancing the material from the first drum first end to the second drum first end through the first chamber, the second chamber and the third chamber.

29. An apparatus according to claim 28 further including a tube disposed in the interior of the second drum and forming a flow passage between the tube and the second drum, the tube having an opening for providing communication between the second drum and the tube.

30. An apparatus according to claim 28 further including:

a carrier separation drum being disposed in the interior of the second drum and forming a fourth chamber between the carrier separation drum and the second drum;

a first communication means for providing communication between the first chamber and the interior of the carrier separation drum through the second chamber and the third chamber;

a second communication means for providing another communication between the first chamber and the interior of the carrier separation drum;

a third communication means for providing communication between the interior of the carrier separation drum and the fourth chamber;

a first flowing means for flowing a portion of the material in the interior of the carrier separation drum;

a second flowing means for flowing a portion of the material in the interior of the fourth chamber; and a transfer means for transferring a portion of the material from the fourth chamber to the interior of the second drum.

31. An apparatus for the treatment of material, comprising:

a rotatable first drum having a first drum first end and a first drum second end;

a second drum rigidly connected to the first drum and disposed in the interior of the first drum to form a first chamber therebetween, the second drum having a second drum first end and a second drum second end;

inlet means for flowing material to the first drum first end;

a third drum disposed over the first drum, the third drum and the first drum forming a second chamber therebetween;

a fourth drum disposed over the third drum, the fourth drum and the third drum forming a third chamber therebetween;

a tube disposed in the interior of the second drum and forming a flow passage between the tube and the second drum, the tube having an opening for providing communication between the second drum and the tube;

means for advancing material from the first drum first end to the second drum first end through the first chamber, the second chamber, the third chamber and the second drum; and outlet means for removing material from the second drum first end.

32. An apparatus for the treatment of material, comprising:

a rotatable first drum having a first drum first end and a first drum second end;

a second drum rigidly connected to the first drum and disposed in the interior of the first drum to form a first chamber therebetween, the second drum having a second drum first end and a second drum second end;

inlet means for flowing material to the first drum first end;

a third drum disposed over the first drum, the third drum and the first drum forming a second chamber therebetween for receiving material from the first chamber;

a fourth drum disposed over the third drum, the fourth drum and the third drum forming a third chamber therebetween for receiving material from the second chamber;

a carrier separation drum being disposed in the interior of the second drum and forming a fourth chamber between the carrier separation drum and the second drum;

means for advancing the material from the first chamber to the interior of the carrier separation drum through the second chamber and the third chamber;

a means for providing communication between the first chamber and the interior of the carrier separation drum;

a means for providing communication between the interior of the carrier separation drum and the fourth chamber;

a first flowing means for flowing a portion of the material in the interior of the carrier separation drum;

a second flowing means for flowing a portion of the material in the interior of the fourth chamber;

a transfer means for transferring a portion of the material from the fourth chamber to the interior of the second drum; and outlet means for removing material from the second drum first end.

33. An apparatus for the treatment of material, comprising:

a rotatable first drum having a first drum first end and a first drum second end;

a second drum rigidly connected to the first drum and disposed in the interior of the first drum to form a first chamber therebetween, the second drum having a second drum first end and a second drum second end;

inlet means for flowing material to the first drum first end;

means for advancing the material from the first drum first end to the second drum first end;

an enclosure enclosing the first drum and forming a second chamber therebetween, the enclosure having an opening;

a driving means;

a closed loop element disposed over the first drum and connected to and rotatable by the driving means to rotate the first drum, the closed loop passing through the opening;

a first wall closing one end of the enclosure;

a second wall closing another end of the enclosure and integrally attached to the first drum;

first sealing means for sealing between the second wall and the enclosure; and means for supplying compressed air to the opening.

34. An apparatus for the treatment of material, comprising:

a rotatable first drum having a first drum first end and a first drum second end;

a second drum rigidly connected to the first drum and disposed in the interior of the first drum to form a first chamber therebetween, the second drum having a second drum first end and a second drum second end;

inlet means for flowing unprocessed material to the first drum first end;

outlet means sufficiently independent of the inlet means for removing processed material from the second drum first end without contacting the processed material flowing out of the second drum with the unprocessed material flowing to the first drum first end;

means for advancing the material from the first drum first end to the second drum first end;

an extruder tube having an outlet;

extruder inlet means connected to the outlet means and to the extruder tube for flowing a portion of the material from the outlet means to the extruder tube; and a piston longitudinally movable in the extruder tube to compress the material that flows to the extruder tube through the extruder inlet means and to advance the material towards the outlet.

35. An apparatus for the thermal treatment of material, comprising:

a rotatable drum;

an enclosure enclosing the rotatable drum and forming a chamber therebetween, the enclosure having a first opening;

means for supplying a hot gas to the chamber;

a first wall closing one end of the enclosure;

a second wall closing another end of the enclosure and being integrally attached to the rotatable drum;

a first external driving means;

a first closed loop element passing through the first opening and disposed over the drum to rotate the drum, the closed loop being connected to and rotatable by the driving means;

a first sealing means for sealing between the second wall and the enclosure; and a second sealing means for preventing the flow of the hot gas from the chamber to the exterior of the enclosure through the first opening.

36. An apparatus according to claim 35 wherein the closed loop element is a chain and the driving means includes a wheel.

37. An apparatus according to claim 35 wherein the enclosure has a second opening and the apparatus further includes:

a second closed loop disposed over the drum and passing through the second opening;

a second driving means for rotating the second closed loop to rotate the drum; and a third sealing means for preventing the flow of the hot gas from the chamber to the exterior of the enclosure through the second opening.

38. A method of treating material containing solids and liquids, comprising the steps of:

placing the material in a retort;

advancing the material in a first chamber of the retort;

heating the material to form hot solids and hot vapors;

flowing the hot solids and the hot vapors in a second chamber of the retort countercurrently to the material being advanced in the first chamber to exchange heat and to cool the hot solids and the hot vapors; and removing the cooled solids and the cooled vapors from the retort.

39. A method according to claim 38 further including the step of crushing the hot solids in the retort.

40. A method of treating material containing solids and liquids, comprising the steps of:

placing the material in a retort;

advancing the material in a first chamber of the retort;

heating the material to form hot solids and hot vapors;

separating the hot vapors from the hot solids;

flowing the hot solids in a second chamber of the retort countercurrently to the material being advanced in the first chamber to exchange heat thereby cooling the hot solids;

passing the hot vapors in a third chamber of the retort countercurrently to the material being advanced in the first chamber to exchange heat thereby cooling the hot vapors;

removing the cold solids from the retort; and withdrawing the cold vapors from the retort.

41. A retort for processing material, comprising:

a rotatable first drum;

a second drum disposed in the first drum and integrally attached to the first drum, the first drum and the second drum forming a chamber therebetween;

a first wall closing one end of the first drum;

a second wall closing one end of the second drum;

a connector head connected to the first drum;

inlet means for flowing the material to the chamber;

outlet means for removing the material from the interior of the second drum;

means for conveying the material through the chamber and through the interior of the second drum; and means for heating the exterior of the first drum.

42. A retort according to claim 41 wherein the conveying means includes a freely rotatable spiral disposed in either the chamber or in the interior of the second drum.

43. A retort according to claim 41 wherein the conveying means includes:

a fixed spiral being connected to the first drum;

a freely rotatable spiral being disposed in the chamber in series with the fixed spiral;

means for transferring the material from the chamber to the interior of the second drum; and a freely rotatable helical element being disposed in the interior of the second drum.

44. A retort according to claim 41 wherein the connector head is connected to the second drum, and the retort further includes:

first sealing means for sealing between the connector head and the first drum; and second sealing means for sealing between the connector head and the second drum.

45. An apparatus for the thermal treatment of material, comprising:

a first rotating drum having a first drum first end and a first drum second end;

a second drum disposed in the first drum and having a second drum first end and a second drum second end, the first drum and the second drum forming a chamber therebetween;

inlet means for flowing untreated material to the chamber;

first advancing means for advancing the material in the chamber from the first drum first end to the first drum second end, the first advancing means including a freely rotatable spiral disposed in the chamber and around the second drum;

second advancing means for advancing the material in the interior of the second drum from the second drum second end to the second drum first end in a direction which is opposite to the direction of advancement of the material by the first advancing means;

outlet means for removing treated material from the second drum first end without contacting the treated material with untreated material; and means for providing heat to the first drum.

46. An apparatus for the treatment of material, comprising:

a rotatable first drum having a first drum first end and a first drum second end;

a second drum rigidly connected to the first drum and disposed in the interior of the first drum to form a first chamber therebetween, the second drum having a second drum first end and a second drum second end;

inlet means for flowing unprocessed material to the first drum first end;

outlet means sufficiently independent of the inlet means for removing processed material from the second drum first end without contacting the processed material flowing out of the second drum with the unprocessed material flowing to the first drum first end;

means for advancing the material from the first drum first end to the second drum first end; and a tube disposed in the second drum and attached to either the first drum or the second drum to form a flow passage between the tube and the second drum, the tube having an opening for providing communication between the second drum and the tube and a tube outlet for flowing material from the interior of the second drum to the exterior or the second drum.

47. An apparatus according to claim 46 wherein the advancing means including:

a freely rotatable spiral disposed in the flow passage; and a fixed spiral disposed in the flow passage in series with the freely rotatable spiral and integrally attached to the second drum.

48. An apparatus for the treatment of material, comprising:

a rotatable first drum having a first drum first end and a first drum second end;

a second drum rigidly connected to the first drum and disposed in the interior of the first drum to form a first chamber therebetween, the second drum having a second drum first end and a second drum second end;

inlet means for flowing unprocessed material to the first drum first end;

outlet means sufficiently independent of the inlet means for removing processed material from the second drum first end without contacting the processed material flowing out of the second drum with the unprocessed material flowing to the first drum first end;

means for advancing the material from the first drum first end to the second drum first end;

a tube disposed in the second drum and attached to either the first drum or the second drum, the tube forming a flow passage between the tube and the second drum and having an opening for providing communication between the second drum and the tube;

a stationery connector head connected to the first drum, the second drum and the tube;

a first seal for sealing between the connector head and the first drum;

a second seal for sealing between the connector head and the second drum;

a third seal for sealing between the connector head and the tube; and a steam injection line for injecting steam into the outlet means.

49. An apparatus for the treatment of material, comprising:

a rotatable first drum having a first drum first end and a first drum second end;

a second drum rigidly connected to the first drum and disposed in the interior of the first drum to form a first chamber therebetween, the second drum having a second drum first end and a second drum second end;

inlet means for flowing unprocessed material to the first drum first end;

a tube disposed in the second drum and attached to either the first drum or the second drum, the tube forming a flow passage between the tube and the second drum and having an opening for providing communication between the second drum and the tube;

a carrier separation drum disposed between the second drum and the tube and forming a first passageway between the tube and the carrier separation drum and a second passageway between the carrier separation drum and the second drum;

means for advancing material from the first chamber to the first passageway;

means for providing communication between the first passageway and the second passageway;

means for providing communication between the first passageway and the first chamber;

transfer means for transferring a portion of the material from the second passageway to the flow passage;

first flowing means for flowing a portion of the material in the second passageway;

second flowing means for flowing a portion of the material in the first passageway; and outlet means for removing material from the flow passage at the second drum first end.

50. An apparatus according to claim 49 wherein the second flowing means includes a first freely rotatable helical element and a fixed helical element in series, and the third communication means includes a member having a port therethrough, the port extending from the first passageway to the first chamber.

51. An apparatus for the treatment of material, comprising:

a rotatable first drum having a first drum first end and a first drum second end;

a second drum rigidly connected to the first drum and disposed in the interior of the first drum to form a first chamber therebetween, the second drum having a second drum first end and a second drum second end;

inlet means for flowing unprocessed material to the first drum first end;

outlet means sufficiently independent of the inlet means for removing processed material from the second drum first end without contacting the processed material flowing out of the second drum with the unprocessed material flowing to the first drum first end;

means for advancing the material from the first drum first end to the second drum first end;

an enclosure enclosing the first drum and forming a second chamber therebetween, the enclosure having an opening;

a driving means;

a closed loop element disposed over the first drum and connected to and rotatable by the driving means to rotate the first drum, the closed loop passing through the opening;

a first wall closing one end of the enclosure;

a second wall closing another end of the enclosure and integrally attached to the first drum;

first sealing means for sealing between the second wall and the enclosure; and means for supplying compressed air to the opening.

* * * * *